US006523376B2

(12) United States Patent
Baukholt et al.

(10) Patent No.: US 6,523,376 B2
(45) Date of Patent: Feb. 25, 2003

(54) LOCK, IN PARTICULAR FOR MOTOR VEHICLE DOORS

(75) Inventors: Theo Baukholt, Kriftel (DE); Klaus-Peter Rathmann, Frankfurt (DE); Jens Lübben, Schwalbach (DE); Sven Petzold, Wiesbaden (DE)

(73) Assignee: VDO Adolf Schindling AG, Frankfurt (DE)

( * ) Notice: Subject to any disclaimer, the term of this patent is extended or adjusted under 35 U.S.C. 154(b) by 0 days.

(21) Appl. No.: 09/804,428

(22) Filed: Mar. 12, 2001

(65) Prior Publication Data

US 2001/0029759 A1 Oct. 18, 2001

Related U.S. Application Data

(63) Continuation of application No. 08/770,951, filed on Dec. 20, 1996, now abandoned.

(30) Foreign Application Priority Data

Dec. 20, 1995 (DE) ..... 195 47 725
Jan. 10, 1996 (DE) ..... 196 00 524

(51) Int. Cl.[7] ..... E05B 47/08

(52) U.S. Cl. ..... 70/256; 70/257; 70/278.7; 70/279.1; 292/201

(58) Field of Search ..... 70/262–264, 256, 70/257, 277, 278.7, 279.1; 292/201, 199, 216, 336.3

(56) References Cited

U.S. PATENT DOCUMENTS 4,762,348 A * 8/1988 Matsumoto ..... 292/201
4,763,936 A * 8/1988 Rogakos et al. ..... 292/201
4,948,183 A * 8/1990 Yamada ..... 292/201
5,100,185 A * 3/1992 Menke et al. ..... 292/216
5,263,751 A * 11/1993 Priest et al. ..... 292/336.3
5,577,583 A * 11/1996 O'Donnell ..... 292/201
5,577,782 A * 11/1996 Johnson et al. ..... 292/201
5,582,448 A * 12/1996 Inoue ..... 292/336.3
5,613,716 A * 3/1997 Cafferty ..... 292/201
5,680,783 A * 10/1997 Kuroda ..... 292/201
5,697,236 A * 12/1997 Kleefeldt et al. ..... 70/262
5,715,713 A * 2/1998 Aubry et al. ..... 292/201
5,722,272 A * 3/1998 Bridgeman et al. ..... 70/277
5,738,393 A * 4/1998 Chao ..... 292/DIG. 62
5,777,395 A * 7/1998 Rathmann ..... 70/264
5,992,194 A * 11/1999 Baukholt et al. ..... 70/264 X
6,112,564 A * 9/2000 Rathmann et al. ..... 292/201 X

FOREIGN PATENT DOCUMENTS

DE 3150620 * 6/1983 ..... 292/201
EP 0159238 * 10/1985 ..... 292/201
EP 0589158 3/1994
GB 2263769 * 8/1993 ..... 292/201

* cited by examiner

*Primary Examiner*—Lloyd A. Gall
(74) *Attorney, Agent, or Firm*—Martin A. Farber

(57) ABSTRACT

A lock suitable for use in a motor vehicle door has a rotary latch, a locking wedge, a pawl, a setting device, and a transmission device wherein the rotary latch cooperates with the locking wedge to be locked in a locking position by the pawl. Upon actuation of a manipulator, the setting device brings the pawl electrically at least into one opening position. The transmission device brings the pawl into its opening position by actuation of the manipulator over a displacement range which is greater than a displacement range of an electric unlocking.

22 Claims, 20 Drawing Sheets

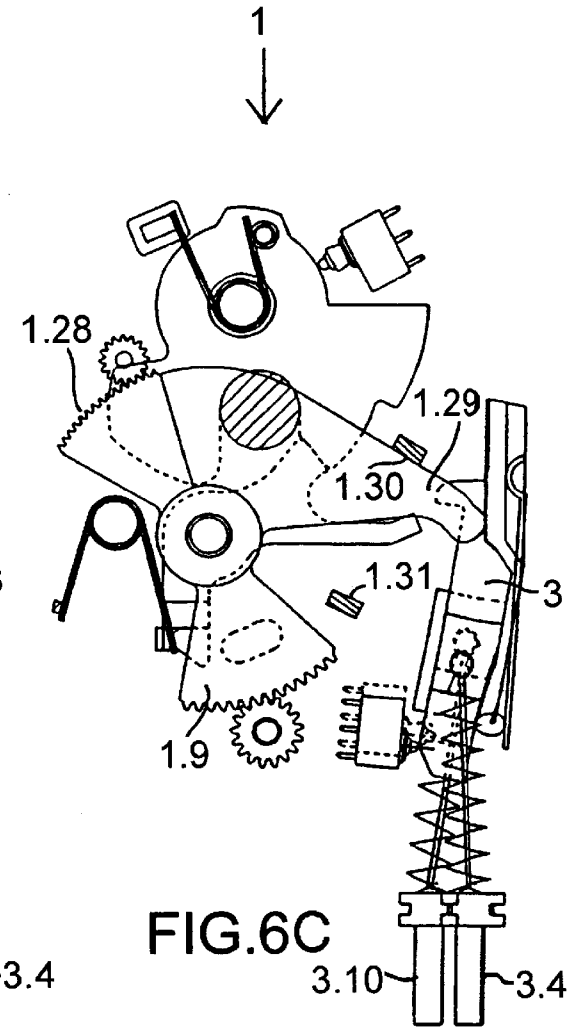
FIG.6A
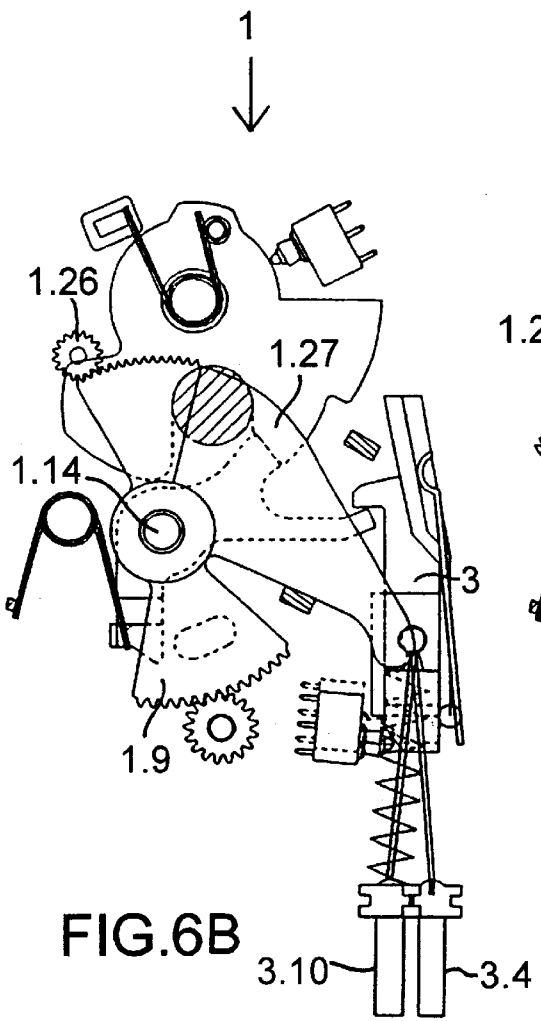
FIG.6B
FIG.6C

LOCK, IN PARTICULAR FOR MOTOR VEHICLE DOORS

RELATED APPLICATION

This is a continuing application of our application Ser. No. 08/770,951 (now abandoned) filed Dec. 20, 1996 under 35 USC 120, the entire contents of which are incorporated by reference herein.

FIELD AND BACKGROUND OF THE INVENTION

The present invention relates to a lock, particularly a lock for motor vehicle doors, which is electrically operable and has an emergency opening.

A lock (1) is known, in particular for motor vehicle doors, which has a rotary latch (1.1) which cooperates with a locking wedge (1.5) or the like and can be locked in a locking position by a pawl (1.3), in which connection, upon actuation of a manipulator (for instance, door inside handle or door outside handle), a setting device brings the pawl (1.3) electrically at least into one opening position. The lock includes a transmission device which brings the pawl (1.3) into its opening position by actuation of the manipulator over a displacement range which is greater than an electric unlocking.

Such a lock is known from European Patent Application 0 589 158 A1, which has a rotary latch which cooperates with a closure bolt or the like and is locked in a locking position by a pawl. A manipulator is connected by an electric line to a motorized setting drive which, upon actuation of the manipulator, acting with a displaceable actuator on the pawl, moves the pawl into its opening position when a switch, arranged in the electric line, is brought into active position by a corresponding switch command of a receiver or a device connected therewith. In the normal case, in the case of microswitches which are placed in active position individually or jointly, an electromechanical unlocking of the pawl is provided. An additional mechanical unlocking is used only in the event of malfunctions and is placed in action in such cases by the receiver, by the central electronic system of the car body, or by a switch.

One embodiment provides an additional mechanical actuating mechanism having a swing lever which is in a safety position in which the swing lever cannot cooperate with the pawl. By cooperation of the swing lever with the setting drive, the swing lever can be swung by the setting drive into its active position, the actuator passing from a normal position into an actuation position. For this purpose, the setting drive is controlled in corresponding manner by the receiver. The swing lever is arranged on a support part which, by actuation of the handle, can be displaced linearly from a position of rest into an actuating position. If the swing lever is in its active position, the mechanical displacement of the support part effects a carrying-along of the arm on the pawl, as a result of which the pawl swings into its unlocking position which releases the rotary latch. As an alternative to this, it is provided that the entire setting drive is displaced or turned.

These arrangements have the disadvantage that in the event of a failure of electrical or electronic parts (for instance of the switches) or of the voltage supply, it must be seen to it that the load-free actuator moves into its active position and is held, for instance, in this active position by self-locking, i.e. the movable setting member must, in the event of a malfunction, be moved by electric energy into to a specific position in order, by actuation of the manipulator (door inside handle or door outside handle) over a larger region of displacement than the electric unlocking, to effect a mechanical opening of the doors. However, if there is no electrical energy (for instance, in the event of failure of the battery due to cold or after an accident, or if the terminals of the battery have become disconnected upon stay in a workshop or during transportation of the vehicle) there is no assurance that the actuator can assume its specific position or retain it for a sufficiently long period of time.

SUMMARY OF THE INVENTION

It is an object of the invention to provide a lock having an additional mechanical transmission device for the unlocking which, in the event of a malfunction, in particular without electric energy or upon failure of the electric current supply, can be effectively actuated.

According to the invention, the pawl (1.3) can be actuated by the transmission device regardless of the position of the setting device.

First of all, it should be pointed out that by the expression "electric unlocking" it is to be understood that the unlocking process is triggered by an electric pulse. The pulse can be produced, for instance, by the closing of a switch or else by the contacting of a sensitive sensor or in some other manner (for instance via a remote control). This pulse thereupon, possibly taking into account other parameters such as a child-proof door catch, is converted into setting commands, the setting commands controlling a setting device, which may be a hydraulic, pneumatic, electromagnetic or electromotive setting device. These setting devices act directly or stepped-down (for instance by means of a gearing), possibly with the interposition of a clutch in order to avoid overload on the pawl for the release of the rotary latch or corresponding developments.

The inventive concept now contemplates that the pawl can, in the event of a malfunction, be actuated by the transmission device regardless of the position of the setting device. This has the advantage that, in the event of a malfunction, the lock can be effectively actuated, in other words that an additional mechanical device is proposed which can be effectively actuated upon failure of the electric unlocking. This has the advantage that, in the event of a malfunction, the setting device can assume any position whatsoever, which cannot be foreseen, and the lock can nevertheless be actuated. In this way, the doors can be reliably opened from the inside or outside, in particular without electrical energy or upon failure of the electric current supply, as may occur in the event of an accident on the part of the vehicle.

As a further development there is provided a lock (1) having a control device (10), in which connection the manipulator (10.1) is connected via a signal line (10.4) to the setting device (10.5) which then, upon actuation of the manipulator (10.1), acting on the pawl (1.3), when an actuation-detection device (10.3) arranged in the signal line (10.4) is placed in active position by the control device, brings the latter into its opening position. Therein, the transmission device has, in the region of the pawl (1.3), a swingable lever (3) (inner lever) which has a projection which can be brought into operative connection with an arm (1.22) of the pawl (1.3) upon actuation of the manipulator. There is thus established a structural development for the transmission device which has the advantage that it requires few structural parts, takes up little structural space, and in the event that the projection of the lever is operatively connected with the arm of the locking pawl, is easy to actuate in order to turn the pawl from its locking position in which the rotary latch rests on it, into the opening position.

As a further development of the invention, a linearly movably lever (2) (outer lever) having a projection is arranged in the region of the pawl (1.3), which lever can be brought into operative connection with an arm (1.22) of the pawl (1.3) upon actuation of a lock cylinder. There is thus available an embodiment for turning the pawl by means of the actuation of a lock cylinder with a key from the locking position into the open position. In this way also the lock can be effectively actuated in the event of a malfunction.

As a further development of the invention, the transmission device (in particular, an inner lever (3) or a resting part (3.14) of the lever) has a further setting device associated with it directly, or with the interposition of transmission elements. This has the advantage that, in case of failure of the current supply (for instance in the event of an accident), no additional energy supply system such as, for instance, emergency batteries or condensers is required for the coupling of the transmission device. This serves to provide mechanical redundancy, and the problems related therewith, such as sufficient availability in time of the required energy cannot occur. In the normal case, i.e. with sufficient supply of current, the transmission device is held by the further setting device out of engagement with the pawl and, in the event of a malfunction, is operatively connected with the pawl so that the latter can be actuated via suitable manipulations and the door can be mechanically opened in the event of a malfunction. The further setting device is so developed that it holds the transmission device, particularly the inner lever, in the active state (i.e. in the event that a current supply is available) out of engagement with the pawl. Additionally, when sufficient current supply is no longer available, the setting device brings the transmission device (the inner lever) directly or with the interposition of transmission elements, into operative connection with the pawl for instance by turning, swinging, pushing, pulling, or a combination thereof.

As a further development of the invention, the further setting device is an electromotive, an electromagnetic (for instance electromagnet or clapper relay (1.46)) or pneumatic setting device (4). In this way various structural possibilities exist in order to produce the further setting device and, in particular, to adapt it to the existing structural space and the desired direction of movement and form of movement.

As a further development of the invention, the lever or levers (2, 3) are spring-loaded in the direction of swing and/or of actuation. This has the advantage that the lever or levers are inactive in the normal case and, only in the event of a malfunction, are brought in swinging direction and/or actuation direction into a region in which the lever or levers can, by actuation of the manipulator or of the lock cylinder, be operatively connected with the lever arm of the pawl.

As a further development of the invention, at least the lever (2, 3) in each case is connected by a Bowden cable (3.4, 3.10) to the manipulator (door inside handle or door outside handle or the lock cylinder), and can be actuated independently of each other by the latter. This construction has the advantage that from any desired place (from the inside of the vehicle, from the outside, or by means of a key) the lock can be duly actuated in the event of a malfunction.

As a further development of the invention, the lever (3) has a guide, a pusher connected with the Bowden cables being slidably mounted in a slide block (3.13) in this guide. Furthermore, the pusher is formed of two parts, each part being connected with the Bowden cable (3.4, 3.10). There is thus available a construction which makes it possible to actuate a lever from two different places independently of each other.

As a further development of the invention, the pawl (1.3), or another element actuating the pawl (1.3), has a lever arm which is connected by connecting elements to an inner safety button (1.34). Such inner safety buttons are known per se and are, when the door is closed (particularly in an anti-theft position of the lock), so sunk in the paneling of the door that they are not longer accessible. In the event that the lock is unlocked the inner safety button protrudes above the side paneling so that, if passengers are present in the vehicle, the inner safety button can be actuated in order to permit a locking of the doors (particularly the entire central locking system) from the inside in order to prevent undesired entrance from the outside. By actuation of the door inside handle this condition can, for instance, be done away with again.

According to a further feature of the invention, connecting elements for the direct or indirect movement of the pawl (1.3) in particular via the lever (2.3), into its open position are arranged between the manipulator and the pawl (1.3).

According to another feature of the invention, the setting device has means which, in a third position of the setting device (10.5), move the projection (2.1, 3.1) of the lever (2 or 3) or levers (2, 3) out of the region of the pawl (1.3), so that the pawl (1.3) cannot be brought into its open position by the actuation of the manipulator.

Still further according to a feature of the invention, the third position, at least when energy is present produces an anti-theft position in which the pawl (1.3) cannot be brought into the open position either electromechanically or via the transmission device.

BRIEF DESCRIPTION OF THE DRAWINGS

With the above and other objects and advantages in view, the present invention will become more clearly understood in connection with the detailed description of preferred embodiments, when considered with the accompanying drawings, of which:

FIGS. 6A–6G are stylized elevational views presenting successive stages in the operation of a lock transmission device in accordance with a fourth embodiment of the invention;

BRIEF DESCRIPTION OF THE PREFERRED EMBODIMENTS

Figure 1B:
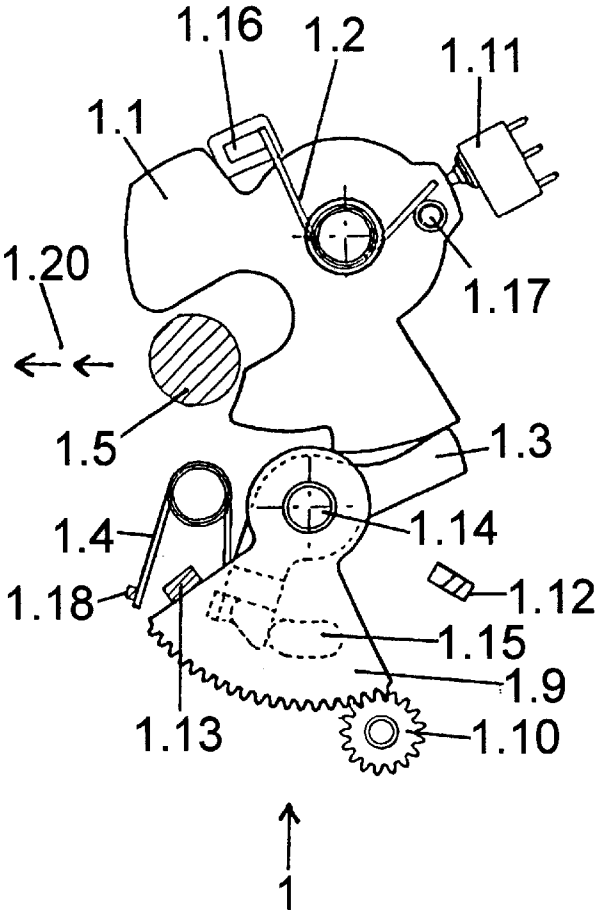
FIG. 1B is an elevational view of a lock in its open position.
Figure 1A:
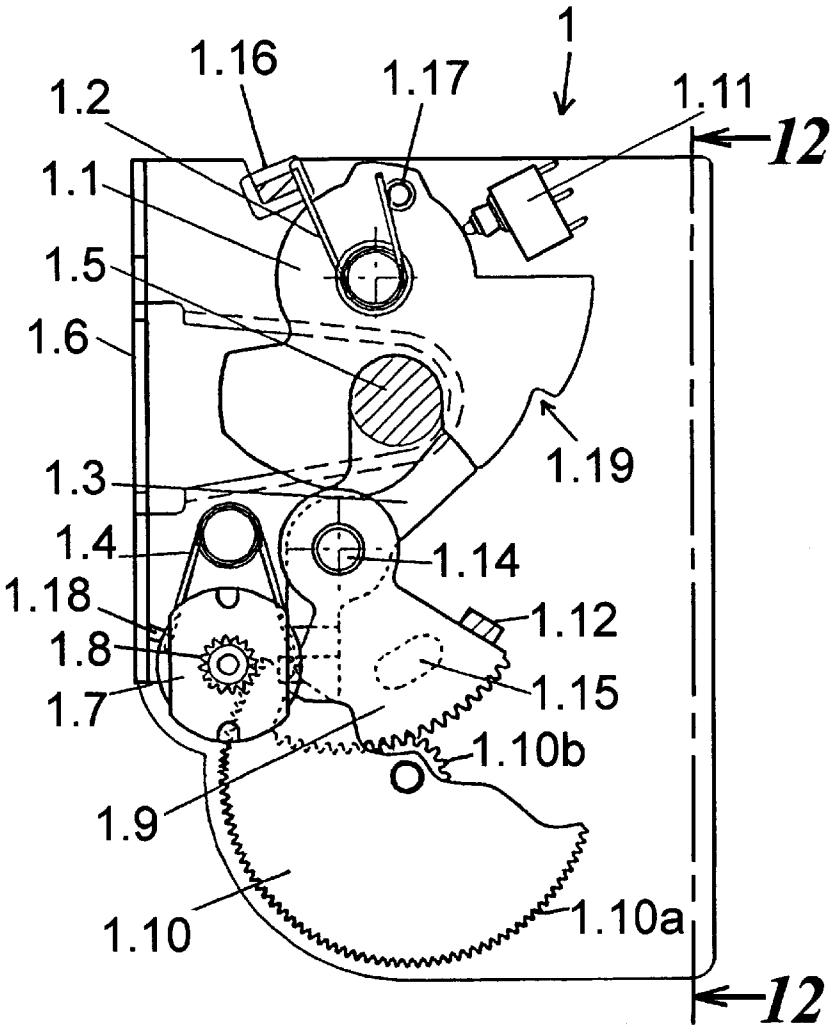
FIG. 1A is an elevational view of a lock in its locked position.

A lock 1, shown in FIGS. 1A and 1B, has a rotary latch 1.1 which acts against a rotary-latch spring 1.2. The rotary latch 1.1 is held in this figure in the locked position shown by a pawl 1.3 which acts against a pawl spring 1.4. The U-shaped rotary latch 1.1 by its two arms surrounds a locking wedge 1.5 and thus holds for instance a car door in known manner in its closed position. The above-indicated parts as well as the following parts are mounted on a lock plate 1.6, in which connection this lock plate 1.6 can also represent a housing which can be easily, simply and in space-saving manner mounted, for instance, within the door of the motor vehicle.

The setting device is developed as an electric motor 1.7 on the output shaft of which there is a pinon 1.8 which is mechanically coupled to a toothed segment 1.9 which then acts on the pawl 1.3. In FIG. 1A, it is shown that the toothed segment 1.9 acting on the pawl 1.3 is connected via a toothed segment 1.10 to the pinion 1.8. In that case, the pinion 1.8 meshes with a large gear wheel 1.10*a* of the toothed segment 1.10, the toothed segment 1.10 having, on the same shaft, a smaller gear wheel 1.10*b* which meshes with the toothed segment 1.9. In this way, the bidirectional movement of the electric motor 1.7 is converted and stepped-down, so as to actuate the pawl 1.3. For the detection of the position of the rotary latch 1.1, a rotary-latch switch 1.11 is provided, which is actuated by a projection on the rotary latch 1.1 when the latter has reached its open position, as shown in FIG. 1*b*.

As further components, the lock 1 has stops 1.12 and 1.13 which limit the end positions of travel of the toothed segment 1.9. For the event that when the toothed segment 1.9 strikes against one of the stops 1.12 or 1.13, the electric motor 1.7 is also connected, a slip clutch can be provided at a suitable point between the electric motor 1.7 and the toothed segment 1.9 so that an overload and thus damage to or destruction of the elector motor 1.7 is prevented.

In the embodiment shown in FIG. 1A, the pawl 1.3 and the toothed segment 1.9 are turnable independently of each other around a pivot point 1.14. A driver 1.15 is associated with the toothed segment 1.9, and, upon actuation of the electric motor 1.7, strikes against an arm of the pawl 1.3, carrying the latter along with it and thus releasing the rotary latch 1.1. The rotary latch 1.1, upon its release, moves automatically into the open position since the rotary latch spring 1.2 is arranged between two stops 1.16 and 1.17. In the same manner, the locking pawl 1.3 is spring-loaded by the pawl spring 1.4, the pawl spring resting on the one hand against the lever of the pawl 1.3 and, on the other hand, against a stop 1.18. In this way, upon actuation of the pawl 1.3, the rotary latch 1.1 is directly released. Furthermore, the rotary latch 1.1 has a shoulder 1.19 in which the pawl 1.3 can, but need not, initially engage. Then, after further movement by the electric motor 1.7, the pawl 1.3 releases the rotary latch 1.1 in its open position, shown in FIG. 1B, whereby a two-stroke release position 1.20 of the vehicle door is made possible.

Figure 2:
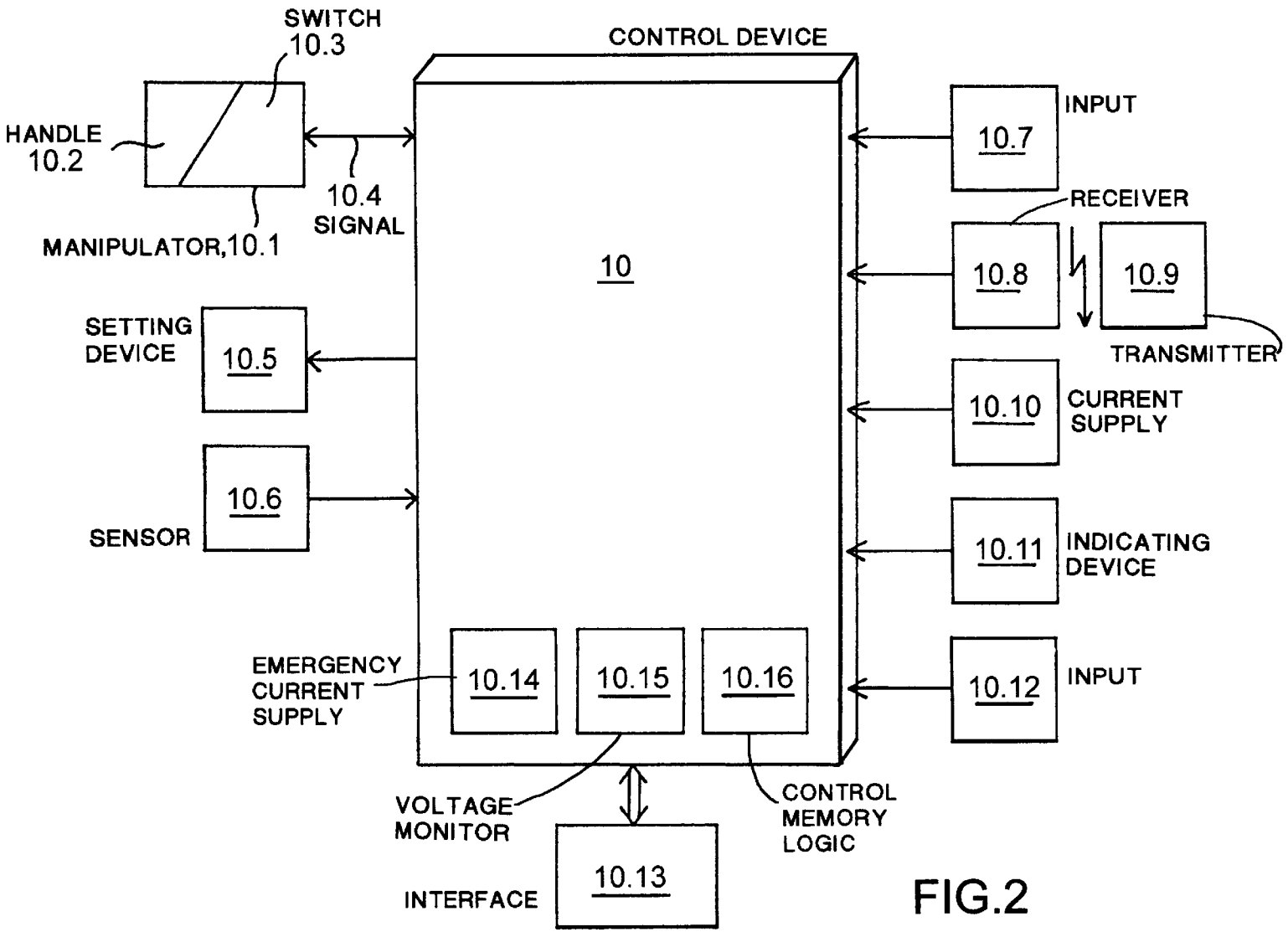
FIG. 2 is block circuit diagram of a control device.

FIG. 2 shows a control device 10 by which the electric motor 1.7 is controlled as a function of opening and closing commands. With the control device 10 there is associated at least one manipulator 10.1 which has a handle 10.2 as well as a switch 10.3 (both shown diagrammatically), which are arranged for instance on the inside and outside of the motor vehicle door. The switch 10.3 is connected by a signal line 10.4 with the control device 10, in which connection, in the event of more than one car door, several manipulators 10.1 can also be present. Furthermore, the control device 10 is connected with the setting device 10.5 (in particular, the electric motor 1.7), the control device 10 receiving information as to the position of the rotary latch 1.1 via a sensor 10.6 (rotary-latch switch 1.11). Furthermore, the control device 10 has, associated with it, an input device 10.7 (for instance a switch for the activating and deactivating of a child-proof device) as well as a receiver 10.8, in which connection opening and closing commands can be transmitted via a transmitter 10.9 to the receiver 10.8.

Furthermore, the control device 10 has, associated with it, a current supply 10.10, an indicating device 10.11 (for the status indication), as well as another input device 10.12 (for special functions, as will be explained further below). In addition, the control device 10 can be provided with an interface 10.13 via which given functions can be established via which further information with regard to the status of the vehicle can be transmitted to the control device 10. An emergency current supply 10.14 and a voltage monitor 10.15, which for instance activates the emergency current supply 10.14 when a predetermined voltage threshold is dropped below, are integrated in the control device 10. Both of the components 10.14 and 10.15 can be present, but need not be. By the reference numeral 10.16 there is indicated an input and output control as well as a control- and memory-logic, with which, for instance, stored in a program, the functions of the control device are carried out.

The control device 10 operates as follows:

First of all, let us assume that the switch 10.3 (and possibly also the other switches) are deactivated so that actuation of the manipulator 10.1 does not produce any movement of the setting device 10.5. This means that the car doors are closed and thus an anti-theft device is connected. If the driver of the vehicle, for instance, desires the opening of at least one door or the actuation of the entire central locking system, he actuates the transmitter 10.9 or, for instance, also the other input device 10.12, the latter being so developed that it can be actuated only under given conditions with which the driver is, for instance, acquainted. This can, for instance, be the entering of a numerical code. After this entry or actuating of the transmitter 10.9, the switch or switches 10.3 are switched into active position. Then, after actuation of the handle 10.2, the setting device 10.5 is actuated, i.e. the electric motor 1.7 is connected until the rotary latch 1.1 is released into its open position by the pawl 1.3 (or until the pawl 1.3 comes against the shoulder 1.19, which can be recognized by another sensor).

When the rotary latch 1.1 has reached its open position, this is recognized by the sensor 10.6 (rotary-latch switch 1.11), and the control device 10.5 is disconnected. After recognition of the open position, a reversal in direction of rotation of the electric motor 1.7 advantageously takes place. Thereby, the toothed segment moves back into the position shown in FIG. 1A and the pawl 1.3 is pressed by the pawl spring 1.4 against the rotary latch 1.1. When the door is closed, the locking wedge 1.5 is pressed into the rotary latch 1.1, and the spring-loaded pawl 1.3 holds the rotary latch 1.1 after a "snapping" in its locking position. As an alternative, it is conceivable also to provide a sensor for detecting the position of the locking wedge 1.5. Thus, when the locking wedge has reached a position such as shown substantially in FIG. 1A, the pawl 1.3 is moved into the locking position via the toothed segments 1.9 and 1.10. For this purpose, in the embodiment shown, the pawl 1.3 would be connected firmly to the toothed segment 1.9.

Based on the construction shown in FIGS. 1A–1B, constructions in accordance with the invention are shown in FIGS. 3 to 5 and described below.

FIGS. 3A–3F shows the lock 1 which, in addition to the components already shown and described, which may possibly be modified in an easily recognizable manner, has an outer lever 2 which is connected to a door outside handle or else to a lock cylinder arranged in the outside region of the vehicle. The outer lever 2 has a nose 2.1 which can be operatively connected with the lever arm 1.22 of the pawl 1.3. Via a rod 2.2 or other transmission elements, the outer lever 2 is connected with the door outside handle or the lock cylinder and carries out substantially a linear movement in a direction of movement 2.3. If the outer lever 2 is actuated, the pawl 1.3 is thereby moved from its locking position into the opening position, so that the door opens.

Furthermore, an inner lever 3, connected for instance with a door inside handle, is integrated in the lock 1. The inner lever 3 also has a nose 3.1 which can be operatively connected with the lever arm 1.22. The inner lever 3 is displaceable linearly on a resting part not further designated in this figure, such part being urged via a spring 3.2 and being swingable around a pivot point, also not further designated. The inner lever 3 has a slot 3.3 which receives the end of a core 3.6, pre-tensioned by a spring 3.5, in a Bowden cable 3.4. For the detecting and evaluating of the movement of the inner lever 3 there is provided an inner lever switch 3.7 which is actuated when the inner lever 3 is moved in a direction of movement 3.8. As shown in FIG. 3B with respect to FIG. 3A, the inner lever 3 carries out a coupling moment 3.9 when the inner lever 3 is released from the nose 1.21 of the toothed segment 1.9.

Figure 3C:
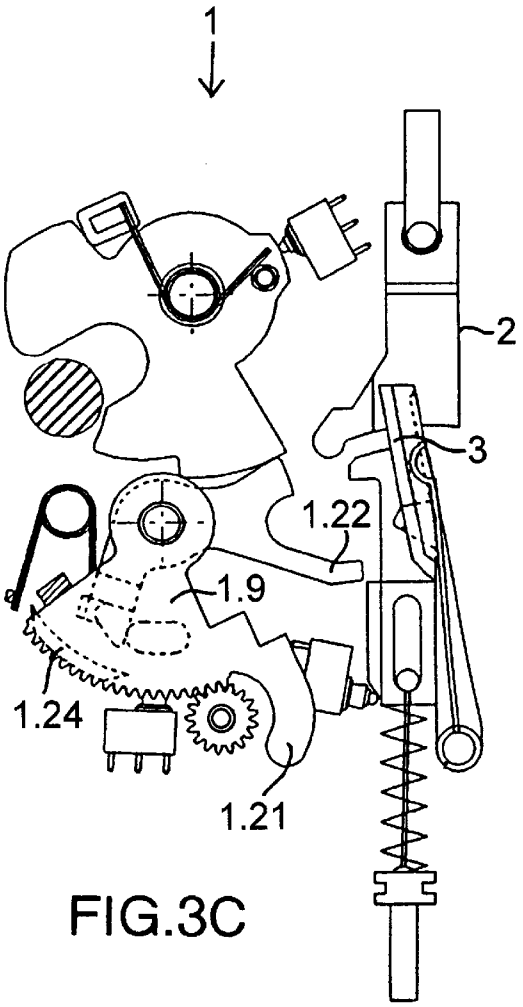
FIGS. 3A–3F are stylized elevational views presenting successive stages in the operation of a lock transmission device in accordance with a first embodiment of the invention.
Figure 3B:
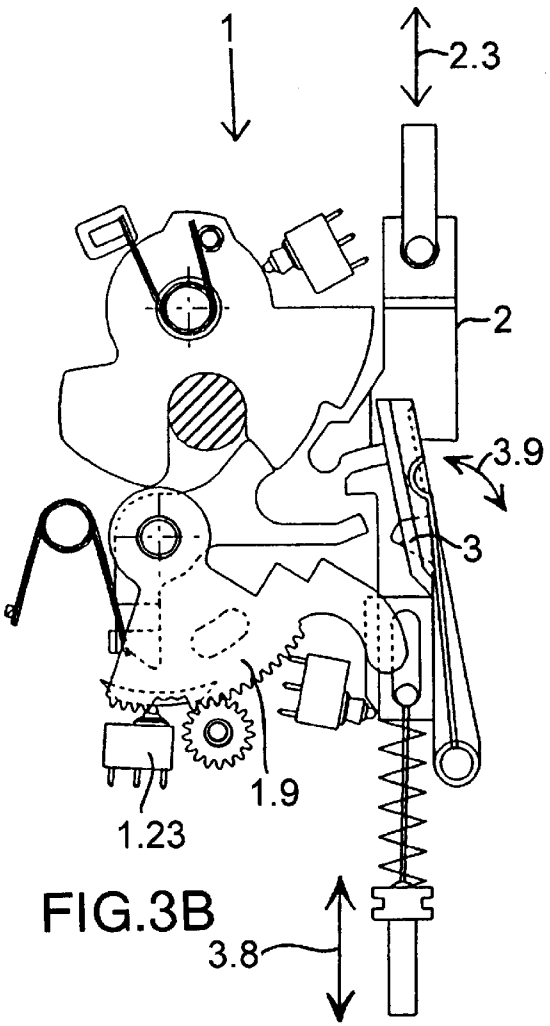
Figure 3A:
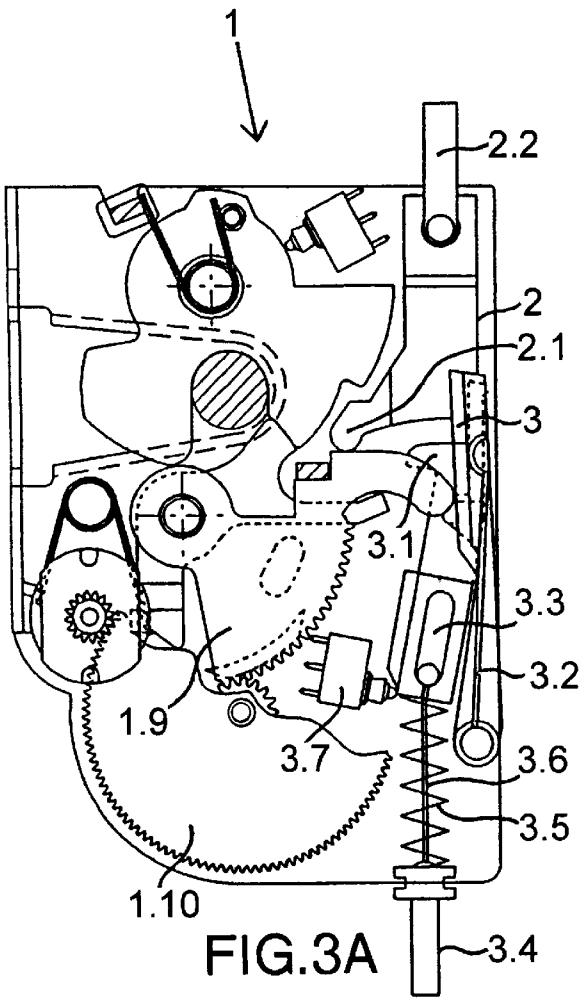

In FIG. 3A, neither the outer lever 2 nor the inner lever 3 is operatively connected with the lever arm 1.22, so that the lock cannot be opened either by the door inside handle or by the door outside handle. This corresponds to an anti-theft position.

Figure 3F:
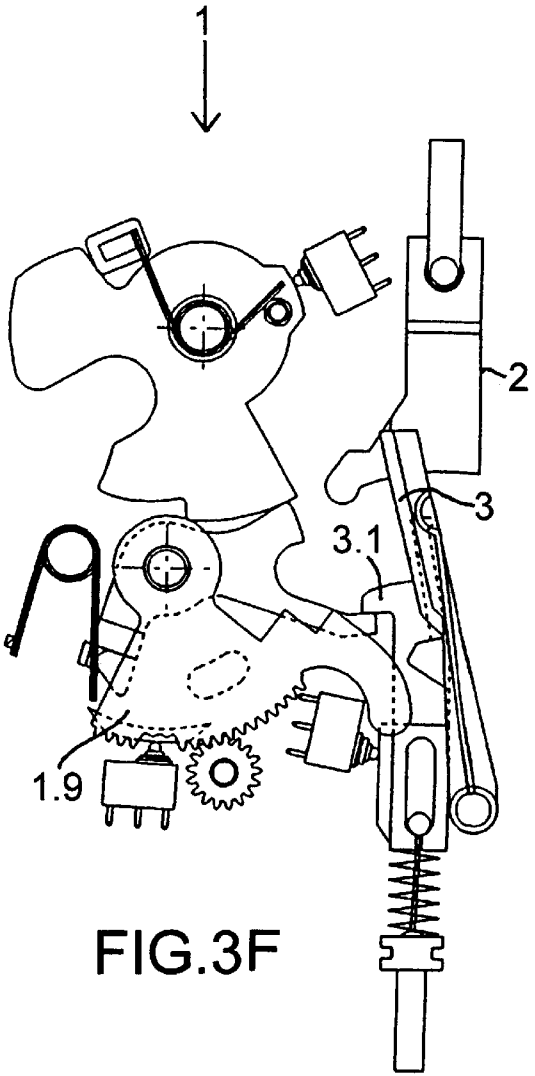
Figure 3E:
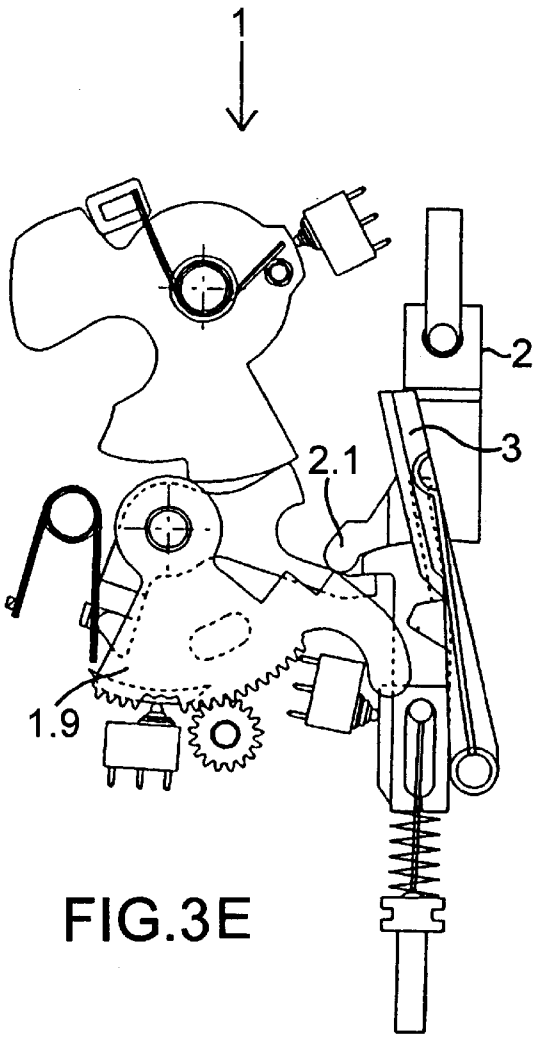
Figure 3D:
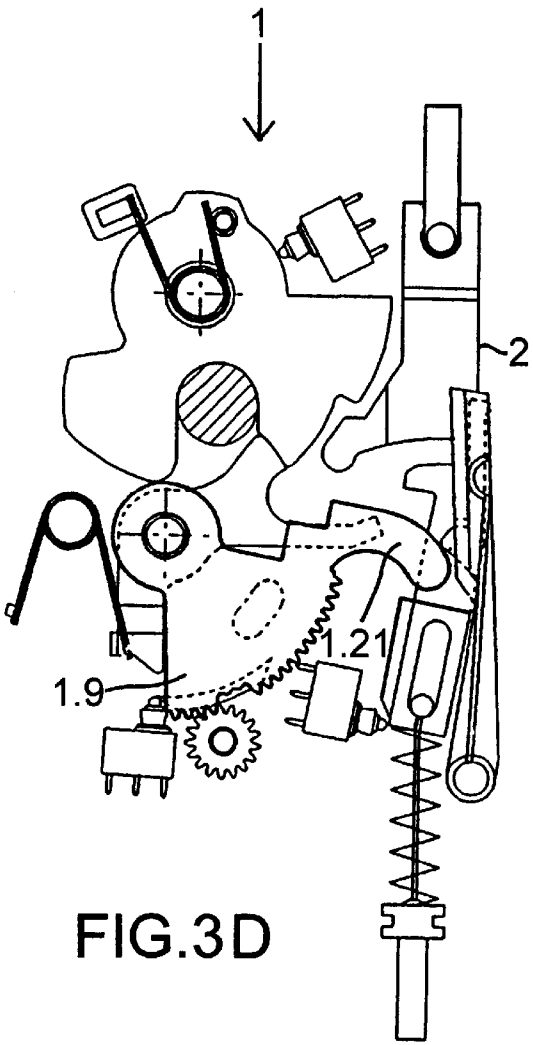

FIG. 3B shows a preparatory position, in which the pawl 1.3 can be brought into an open position on the basis of an opening command by the electric motor 1.7, which position is then shown in FIG. 3C. FIG. 3D shows a position of the toothed segment 1.9 in which the lock 1 can be opened by actuation of the outer lever 2, while the inner lever 3 is brought out of engagement with the lever arm 1.22. FIG. 3E shows the case wherein the outer lever 2 has been actuated, as a result of which its nose 2.1 comes to rest against the lever arm 1.22. The outer lever 2 swings the arm around the pivot point 1.14, and thus releases the rotary latch 1.1, thereby opening the door. FIG. 3F shows the case wherein the door is opened by means of the inner lever 3, the lever nose 3.1 resting against the lever arm 1.22 and turning the pawl 1.3 into its open position.

In addition to the parts already shown in FIGS. 1A–1B and described, FIGS. 4A–4D show, in addition, another Bowden cable 3.10 which also has a core 3.12 which is pretensioned by a spring 3.11. In this case, the outer lever 2 is actuated via a lock cylinder while the inner lever 3 is connected via the Bowden cables 3.4 and 3.10 and their cores 3.6 and 3.12 to the door inside handle and outside handle respectively. In order that, upon the actuation of the door inside handle or the door outside handle, movement independently of each other can take place, a slide block 3.13 is provided which receives the ends of the cores 3.6 and 3.12, which cores are displaceable linearly independently of each other within this slide block.

Figures 4A, 4B, 4C, 4G:
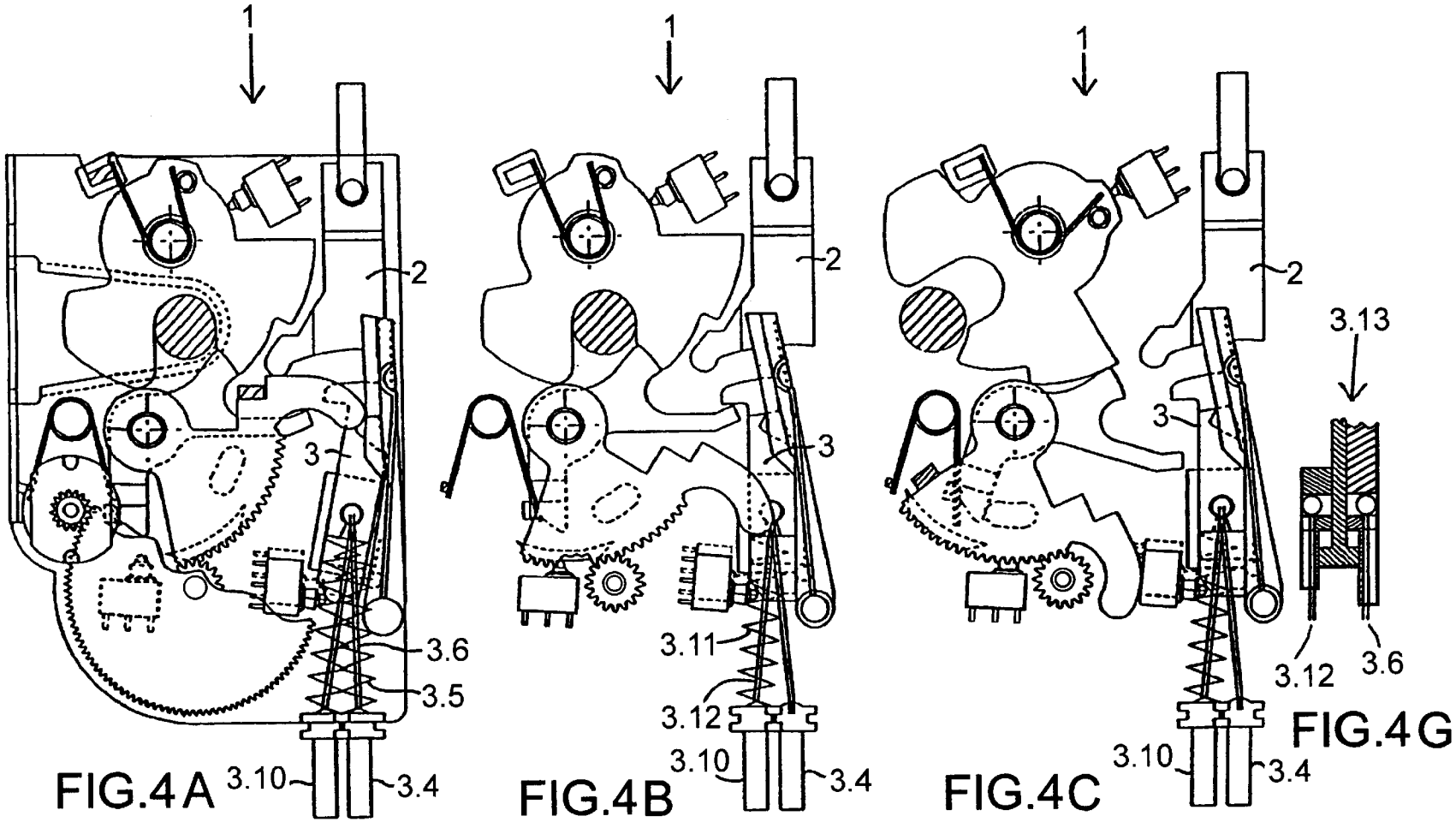
FIGS. 4A–4G are stylized elevational views presenting successive stages in the operation of a lock transmission device in accordance with a second embodiment of the invention.
Figure 4F:
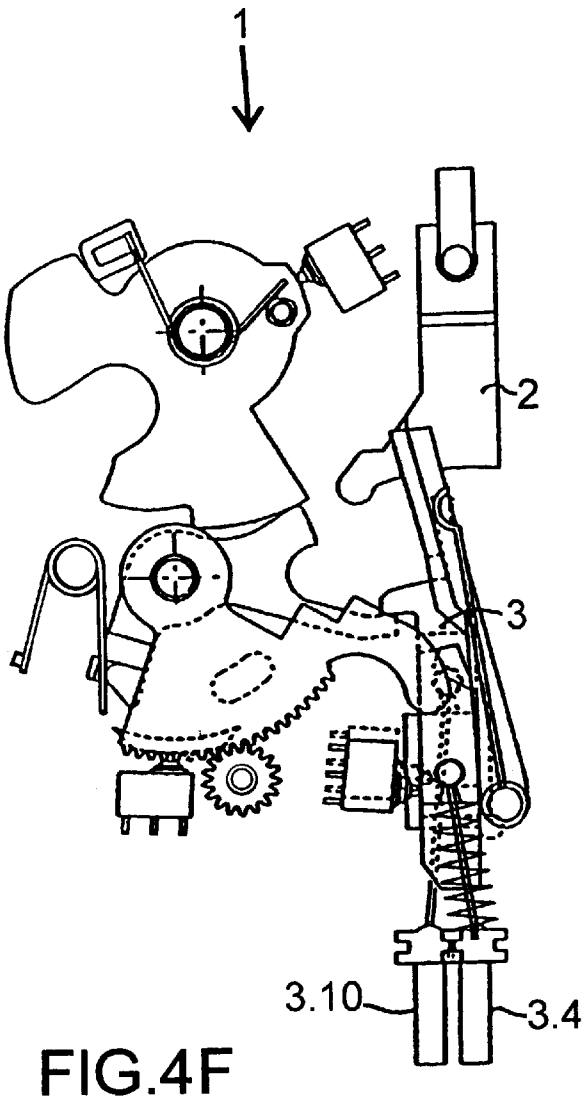
Figure 4E:
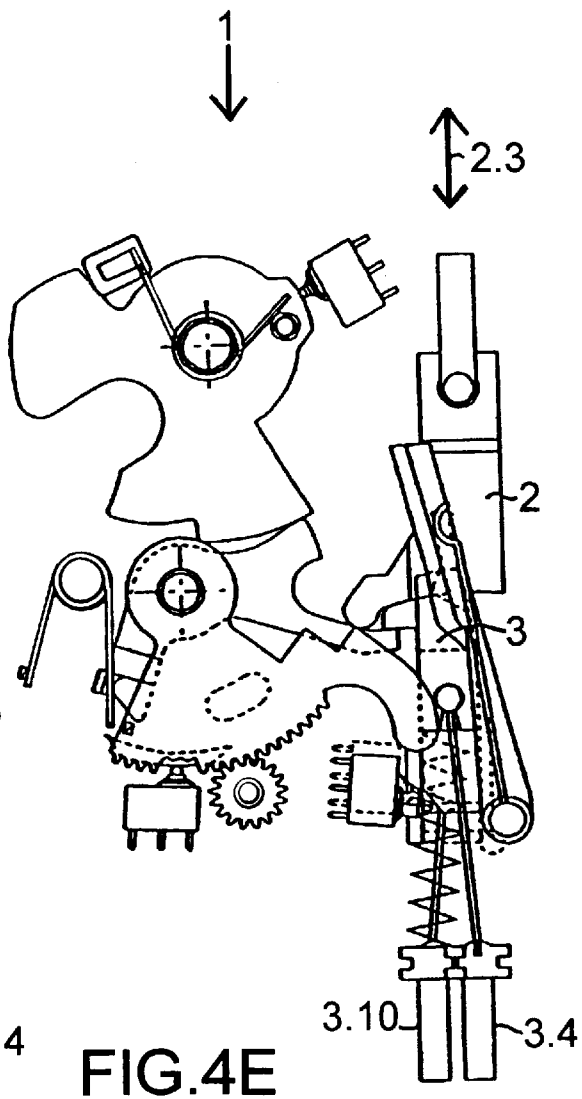
Figure 4D:
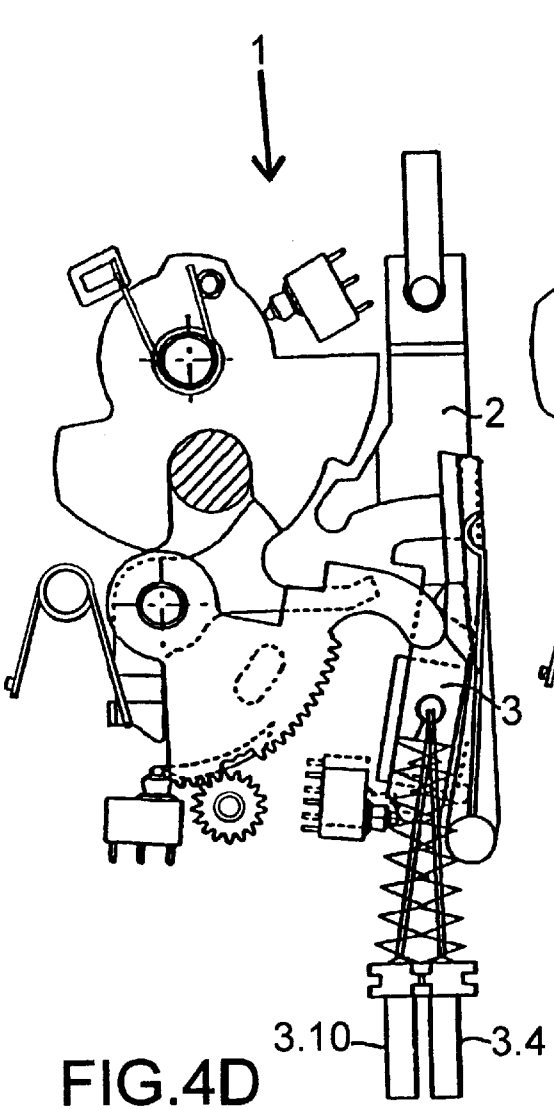
Figures 5A, 5B, 5C, 5F:
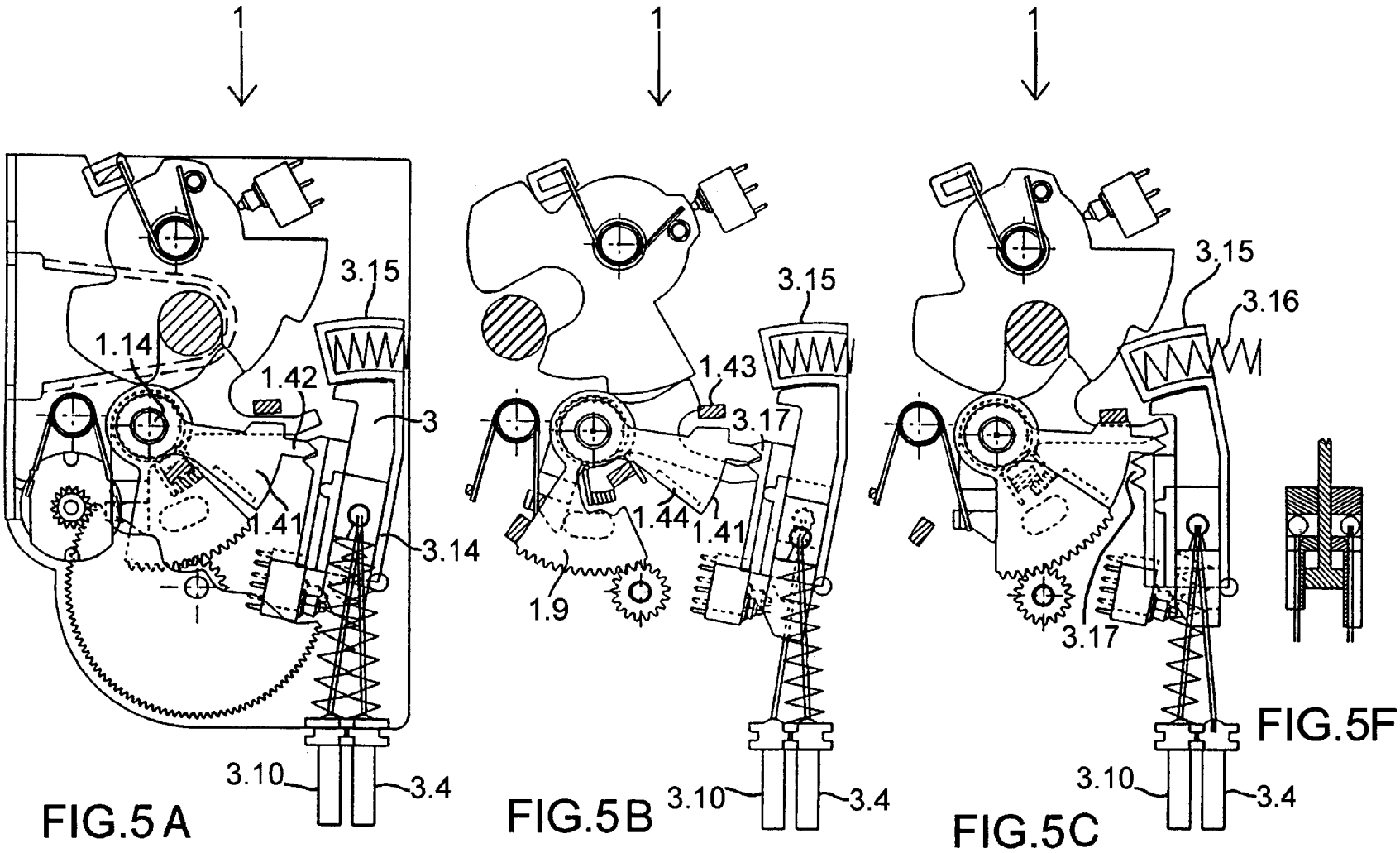
FIGS. 5A–5E are stylized elevational views presenting successive stages in the operation of a lock transmission device in accordance with a third embodiment of the invention.
FIG. 5F is a fragmentary view of the transmission device of FIG. 5C.

FIG. 4A shows the anti-theft position while FIG. 4B shows the locked position of the pawl 1.3. FIGS. 4C, 4G show the open position of the pawl 1.3 which has been set by the electric motor 1.7. FIG. 4D shows a position in which the lock 1 can be opened only by movement of the outer lever 2. Such a position is shown in FIG. 4E in which the outer lever 2 has been moved in the direction of movement 2.3 (downward) and has thus brought the pawl 1.3 from its locked position into its open position. FIG. 4F shows that the door inside handle has been actuated since the inner lever 3 has been pulled downward by the core 3.6 within the slide block 3.13, in which connection it can be noted that the core 3.12 of the Bowden cable 3.10 is independent of this movement.

FIGS. 5A–5F show another embodiment of a transmission device in accordance with the invention. Here again, the inner lever 3 is provided. The lever 3, in the normal case, is brought out of engagement with the lever arm 1.22 of the pawl 1.3 and, in case of malfunction, can be functionally connected with it, so that the door can be opened via the door inside handle and/or the door outside handle. Around the pivot point 1.14 there is turnably arranged an additional coupling element 1.41 which has a projection (nose) 1.42. The coupling element 1.41 is movable up against a stop 1.43. The inner lever 3 is displaceably supported on a resting part 3.14, the resting part 3.14 also being swingable. At its upper end, the resting part 3.14 has a pot 3.15 which receives a spring 3.16 which is pre-tensioned in the normal case. The resting part 3.14 is provided with a triangular recess 3.17 into which the projection 1.42 extends and is in this way fixed in position.

Figure 5E:
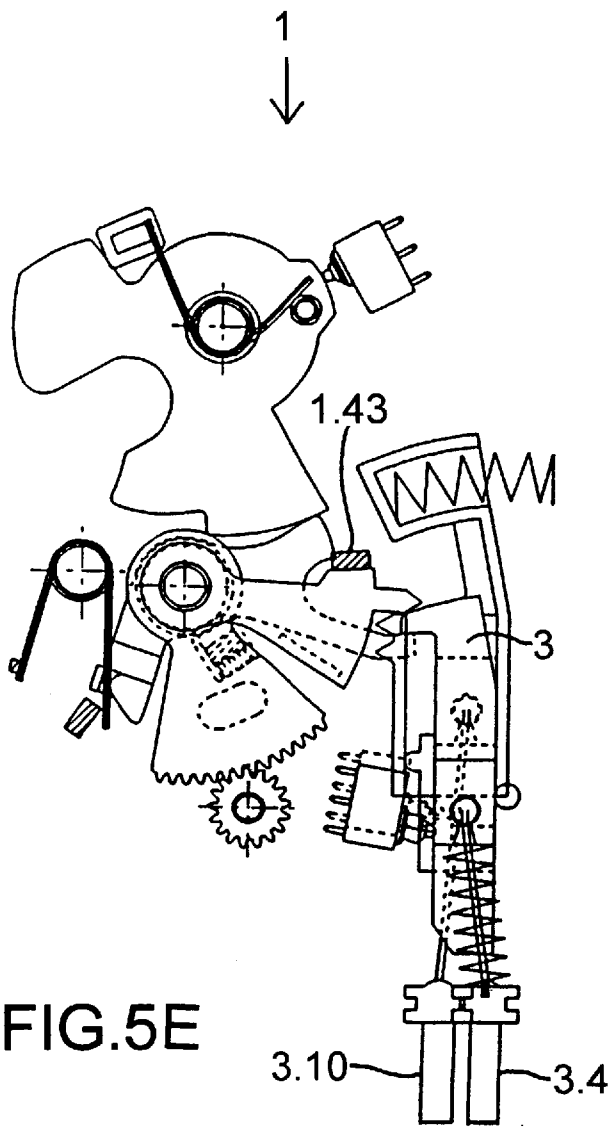
Figure 5D:
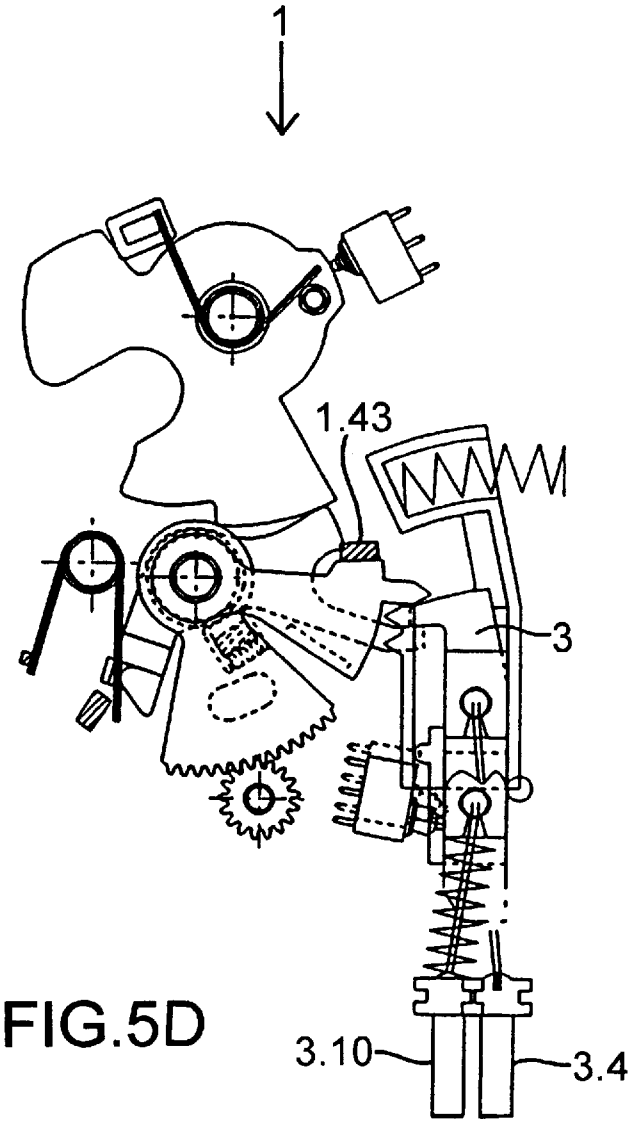

In the normal case, the rotary latch 1.1 is locked or released by the pawl 1.3. In these cases the inner lever 3 is brought out of engagement with the pawl 1.3 by the collaboration between the projection 1.42 and the triangular recess 3.17, so that it is without function. If a malfunction occurs, which is recognized in suitable manner by the control device 10, the coupling element 1.41 is swung into the position shown in FIGS. 5C, 5F by the toothed segment 1.9 which then strikes against a stop 1.44 on the coupling element 1.41, so that the projection 1.42 is moved out of the triangular recess 3.17. In this way, the inner lever 3 is brought with its resting part 3.14 in the direction of the pawl 1.3 in such a manner that the nose 3.1 of the inner lever 3 can be operatively connected with the lever arm 1.22. Thereby, the door can be opened in the event of this malfunction by the door outside handle (FIG. 5D) or the door inside handle (FIG. 5E). The arrangement and the geometrical development of the projection 1.42 and of the triangular recess 3.17 are so selected in this connection that after the recognition of a malfunction and the corresponding swinging of the coupling element 1.41 (FIGS. 5C, 5F) the position for the normal case (FIG. 5A or 5B) can be set again. A return into the normal position can be effected, for instance, by means of a spring which acts on the coupling element 1.41.

Figures 6D, 6E, 6F, 6G:
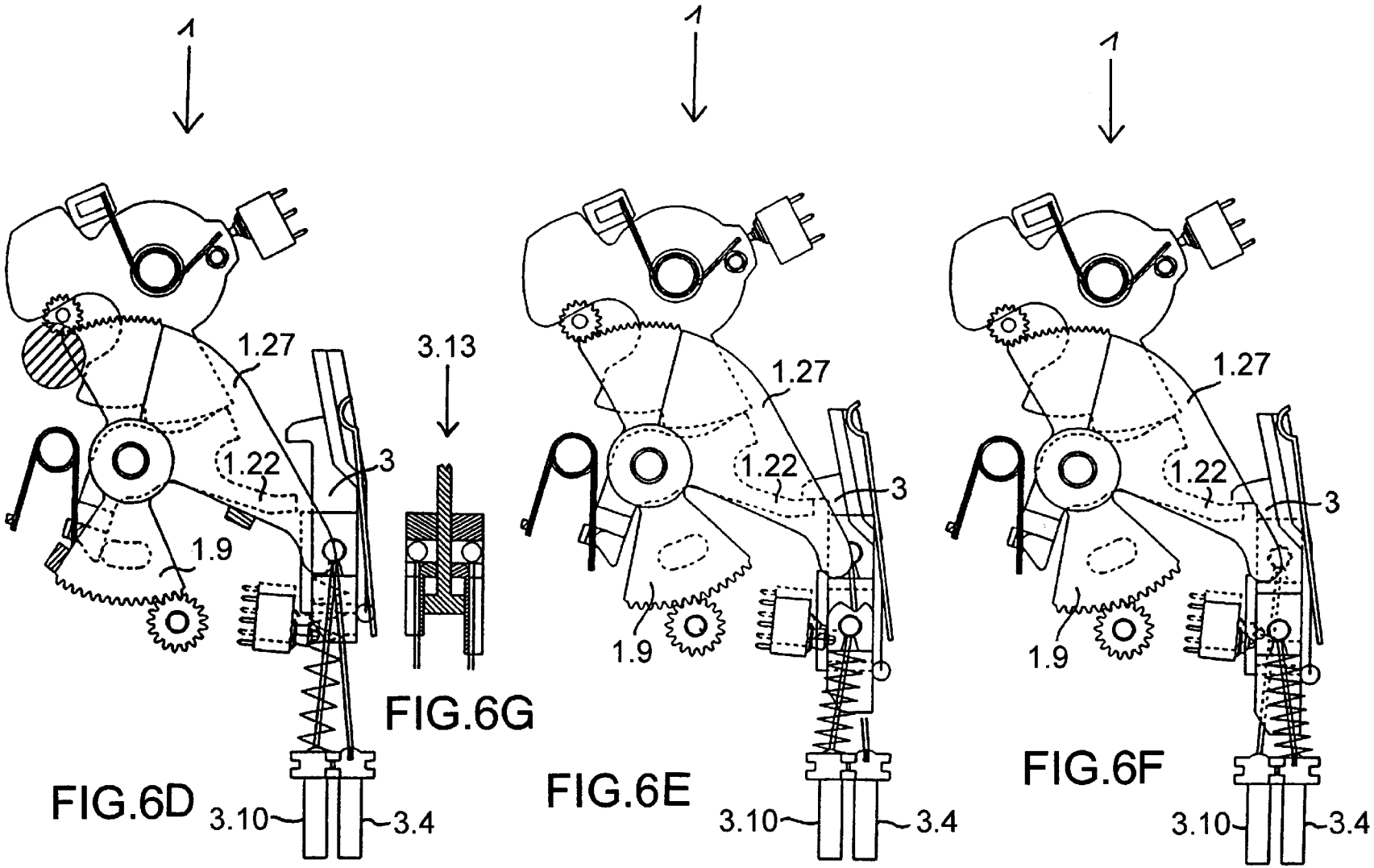

FIGS. 6A–6G show another embodiment in which another electric motor 1.25 is provided which bears a pinion 1.26 on its output shaft. The electric motor 1.25 is connected to the control device 10 and is actuated by it. Around the pivot point 1.14 there is arranged another swing lever 1.27 having a toothed segment 1.28 which has an arm 1.29. The toothed segment 1.28 meshes with the pinon 1.26. For the limiting of the movement of the arm 1.29, stops 1.30 and 1.31 are provided. FIG. 6A shows the position that the inner lever 3 is brought by the arm 1.29 out of engagement with the lever arm 1.22, which again corresponds to an anti-theft position.

In FIG. 6B, the electric motor 1.25 is so controlled that the inner lever 3 can be brought into operative connection with the lever arm 1.22, but this has not yet been done. FIG. 6C shows again, in a different view, the anti-theft position, while FIGS. 6D, 6G show that the pawl 1.3 has been moved into its open position by the electric motor 1.25. The inner lever 3 is again connected via the cores to the door inside handle or outside handle, in which case the slide block 3.13 is also used again here.

An emergency unlocking by actuation of the inner lever 3, which has been released by actuation of the door inside handle or door outside handle, is shown in FIGS. 6E and F. In this connection, the inner lever 3 is in each case moved downward, its nose 3.1 being brought against the lever arm 1.22 and thus moving the pawl 1.3 into its open position.

Figure 7C:
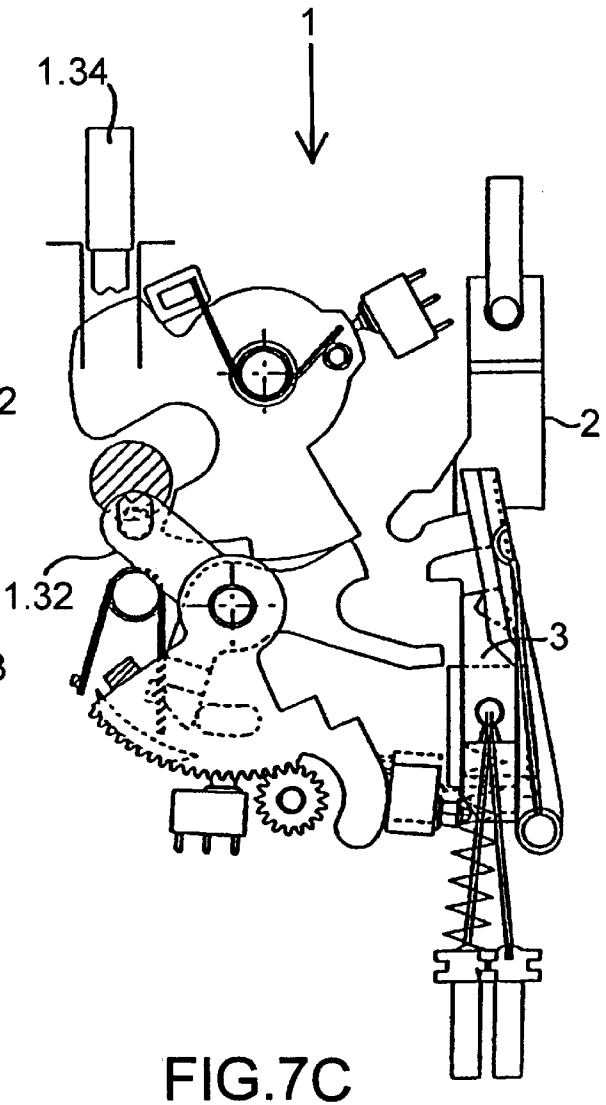
FIGS. 7A–7C are stylized elevational views presenting successive stages in the operation of a lock transmission device in accordance with a fifth embodiment of the invention.
Figure 7B:
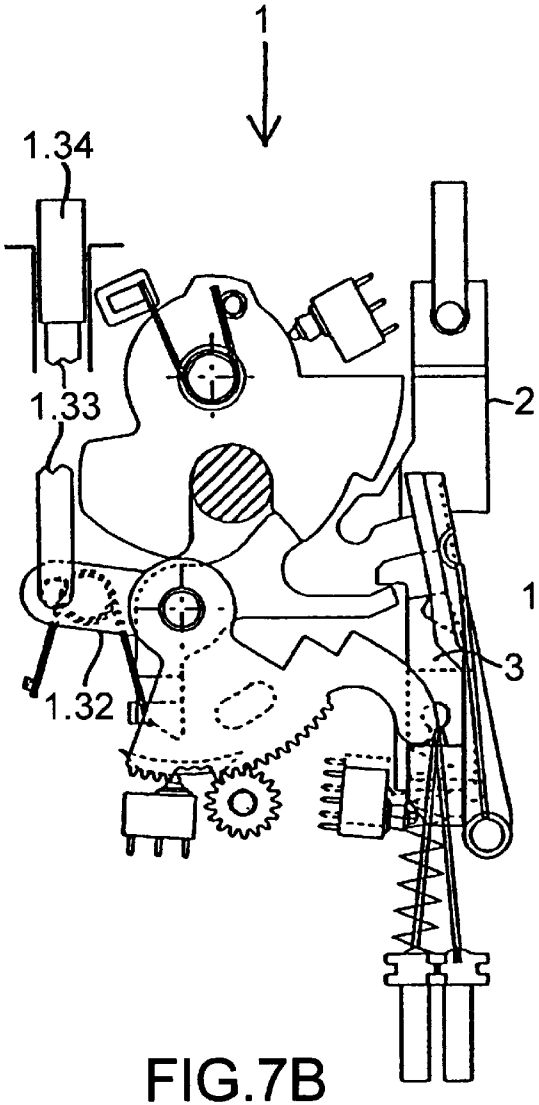
Figure 7A:
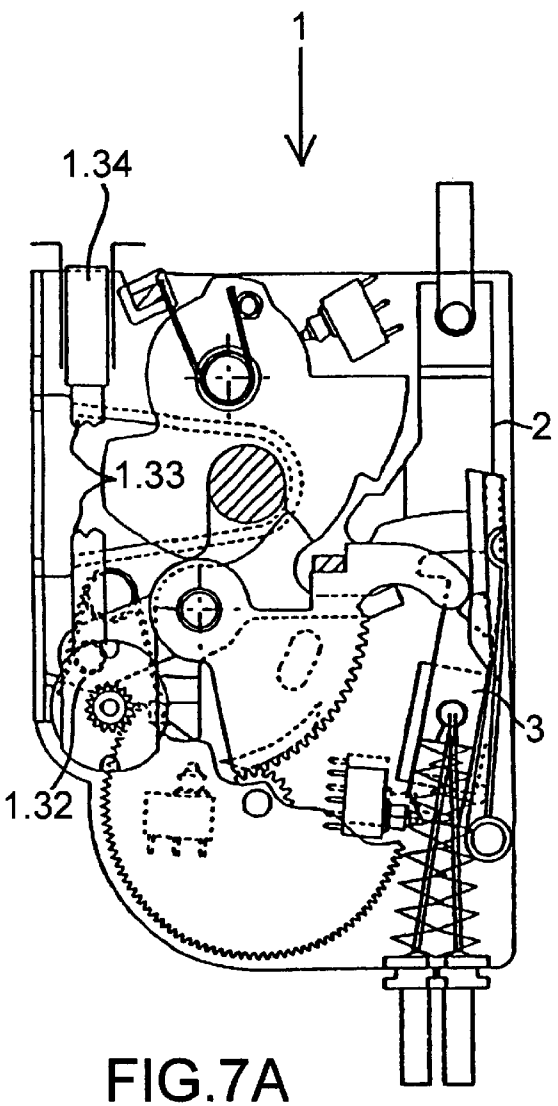

In FIGS. 7A–7C, in addition to the actuation of the pawl 1.3 by the outer lever 2 or the inner lever 3 which has already been shown and described, it is furthermore shown that the pawl 1.3 (or the toothed segment 1.9), has approximately as an extension to the lever arm 1.22, an extension 1.32 on which an inner safety button 1.34 is movably arranged via rotatably mounted connecting elements 1.33 (for instance a rod). In the anti-theft position shown in FIG. 7A this inner safety button 1.34 is recessed completely in the inside paneling of the door, while, in the case of the neutral position (FIG. 7B), the door can be opened by electric motor or via one of the levers, it extends approximately halfway out of the inner paneling. In addition to the electromotive opening of the door or the opening via the outer lever 2 or the inner lever 3 the pawl 1.3 can be actuated by the inner safety button 1.34 (by pulling it up) and the door thus be opened.

Figure 8C:
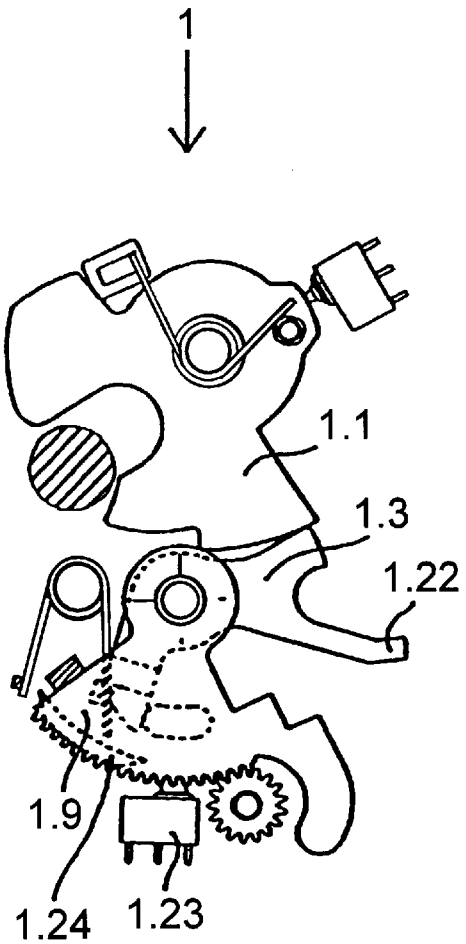
FIGS. 8A–8F are stylized elevational views presenting successive stages in the operation of a lock transmission device in accordance with a sixth embodiment of the invention.
Figure 8B:
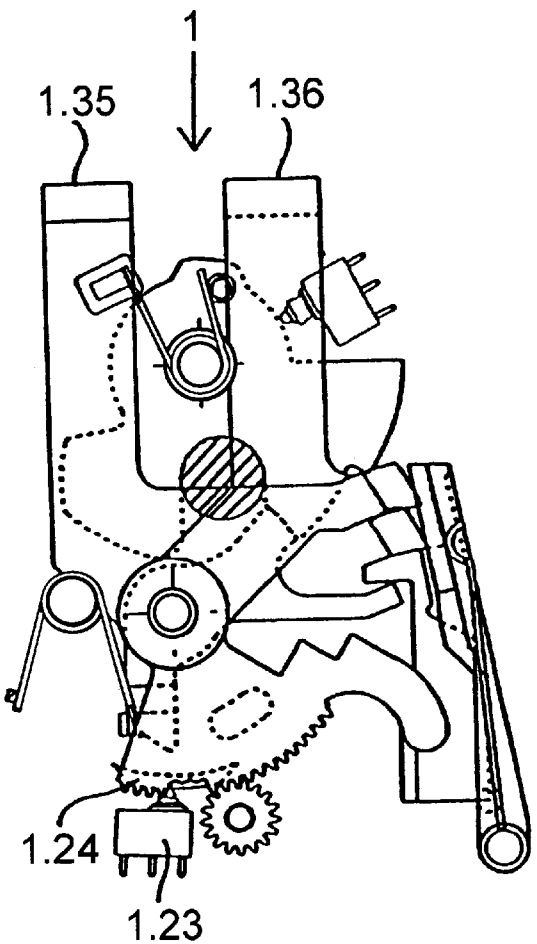
Figure 8A:
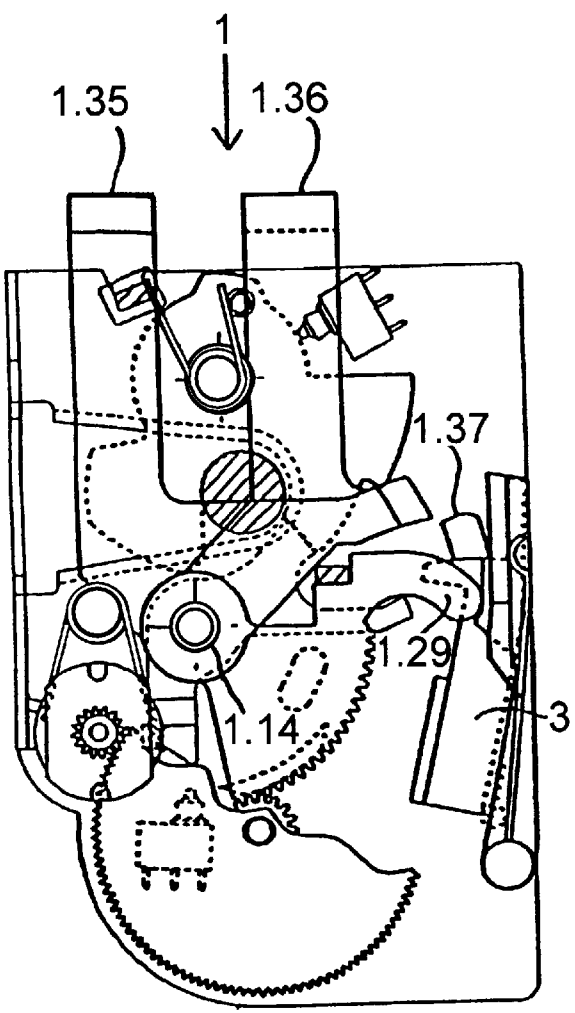
Figure 8F:
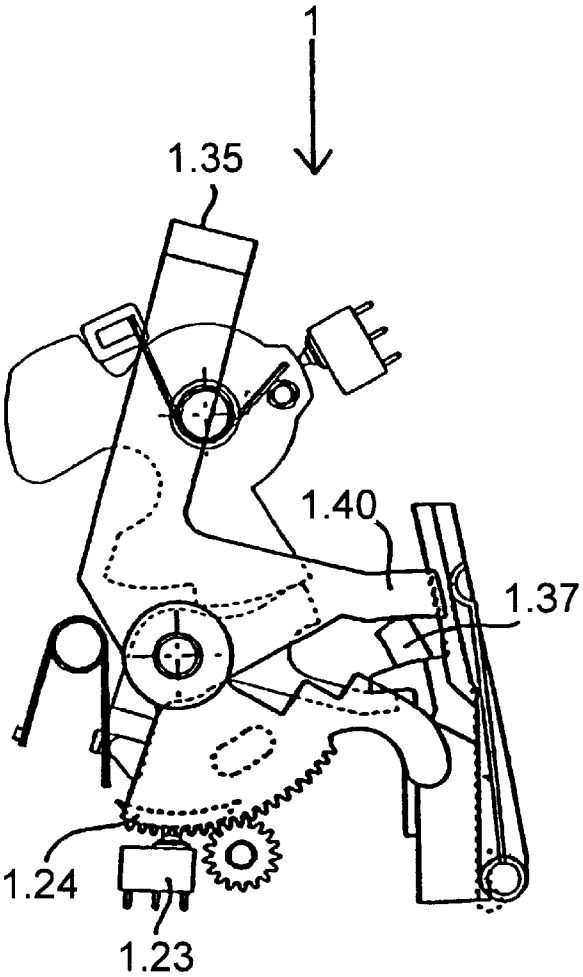
Figure 8E:
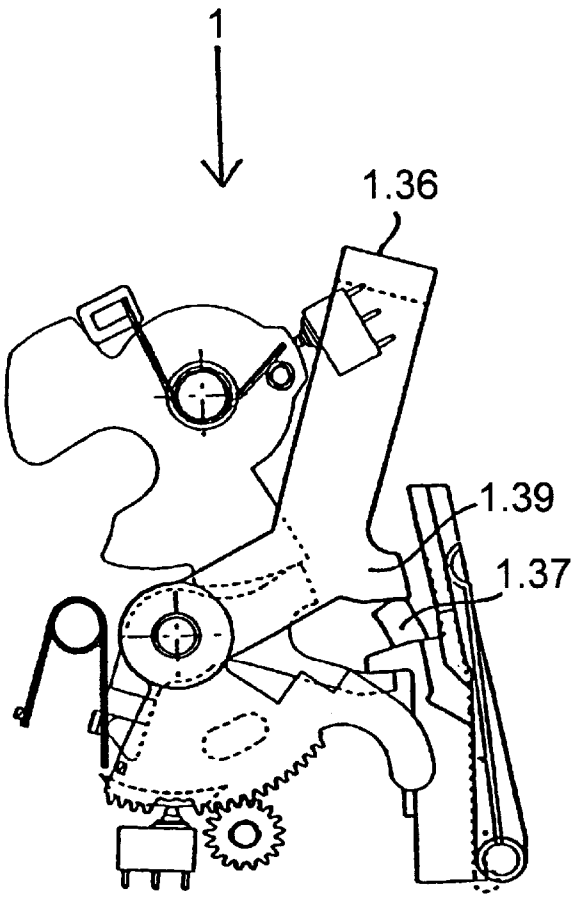
Figure 8D:
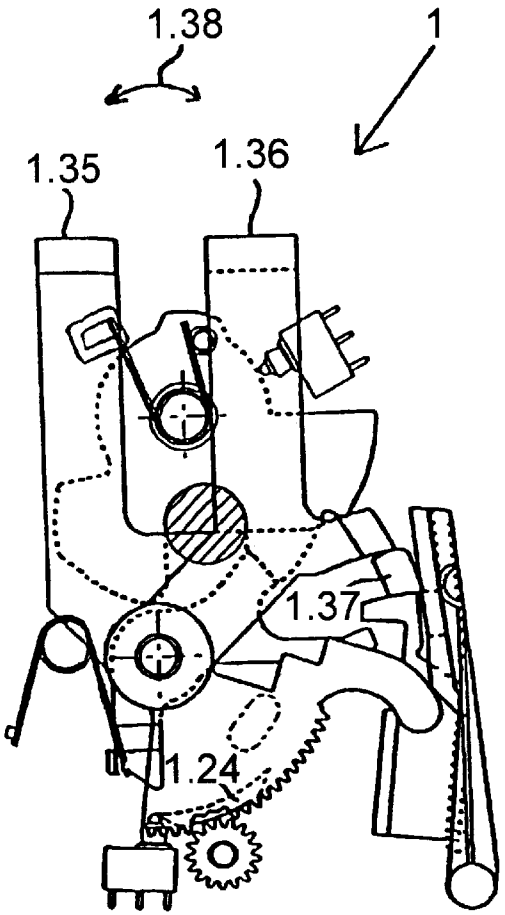

FIGS. 8A–8F, in addition or as alternative to the embodiments already described and shown, shows activating elements 1.35 and 1.36 which can be present alone or jointly, are actuatable independently of each other, and are located preferably in the vicinity of the lock 1. These actuating elements 1.35 and 1.36 serve for the emergency opening and are preferably turnable around the pivot point 1.14 and act on a hump 1.37 which is arranged on the inner lever 3, upon a swinging 1.38 around the pivot point 1.14 (FIG. 8D). The inner lever 3 is initially held at a distance by the arm 1.29 of the toothed segment 1.9. This is the case in the anti-theft position (FIG. 8A). In order to enter into the neutral position (FIG. 8B), an electromotive swinging of the toothed segment 1.9 takes place so that the inner lever 3 is swung into its active position. In this way, its nose 3.1 can be operatively connected with the lever arm 1.22 of the pawl 1.3 (FIG. 8C).

In the normal case, an electromotive rotation of the pawl 1.3 into its open position (FIG. 8C) takes place, so that in the normal case a movement of the actuating elements 1.35 and 1.36 is not necessary. In FIG. 8B it is shown that the toothed segment 1.9 again has the recess 1.24 which is associated with the switch 1.23 for detecting the position of the toothed segment 1.9. In FIG. 8B (neutral position) the switch 1.23 is not actuated, while in the open position shown in FIG. 8C, the switch has left the region of the recess 1.24 and has thus been actuated.

In contradistinction to this, FIG. 8D shows a case of a malfunction in which the switch 1.23 in the locked position of the pawl 1.3 has left the region of the recess 1.24, or else, it can be assumed that the switch 1.23 is defective. Since, in this case, the control device 10 receives no signal or a false signal as to the position of the toothed segment 1.9, a correct control of the electric motor 1.7 is no longer possible. Then an emergency opening is possible by means of the swinging 1.38 of one of the two actuating elements 1.35 or 1.36. Upon the swinging of the actuating element 1.36, a nose of this actuating element is operatively connected with the hump 1.37, whereby the nose 3.1 of the inner lever 3 is again operatively connected with extension 1.22 of the pawl 1.3 and thus releases the rotary latch 1.1. The same movement takes place upon a swinging of the actuating element 1.35, which has an extension 1.40, which is then operatively connected with the hump 1.37 (FIGS. 8E and F). The actuating elements 1.35 and 1.36 can preferably be reached and actuated only from the inside of the vehicle in order to prevent unauthorized actuation from the outside.

The embodiments shown in FIGS. 9A–10F are also based on the structural embodiment which is shown in FIG. 1A and in part in the other previous figures.

Figure 9C:
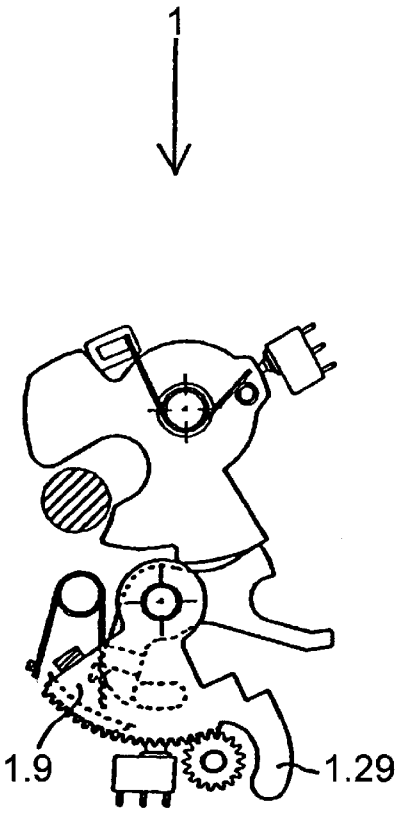
FIGS. 9A–9F are stylized elevational views presenting successive stages in the operation of a lock transmission device in accordance with a seventh embodiment of the invention.
Figure 9B:
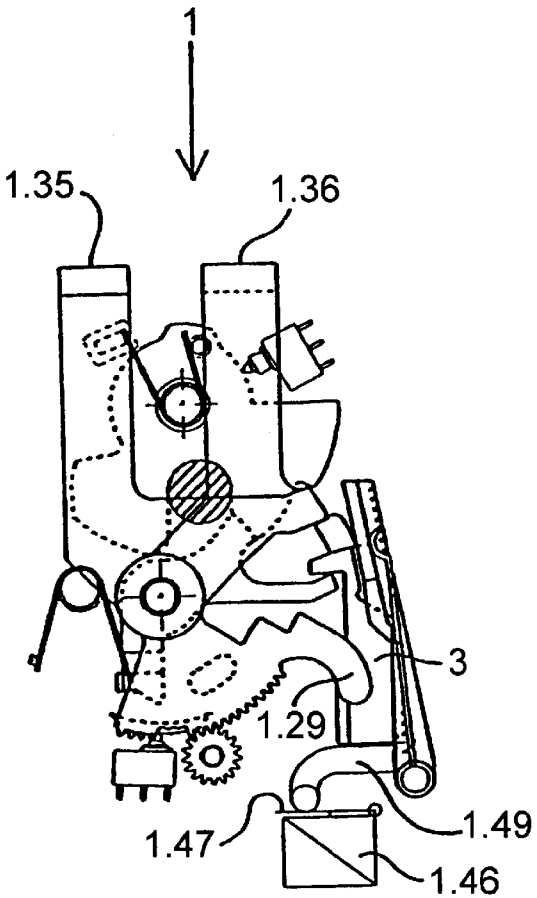
Figure 9A:
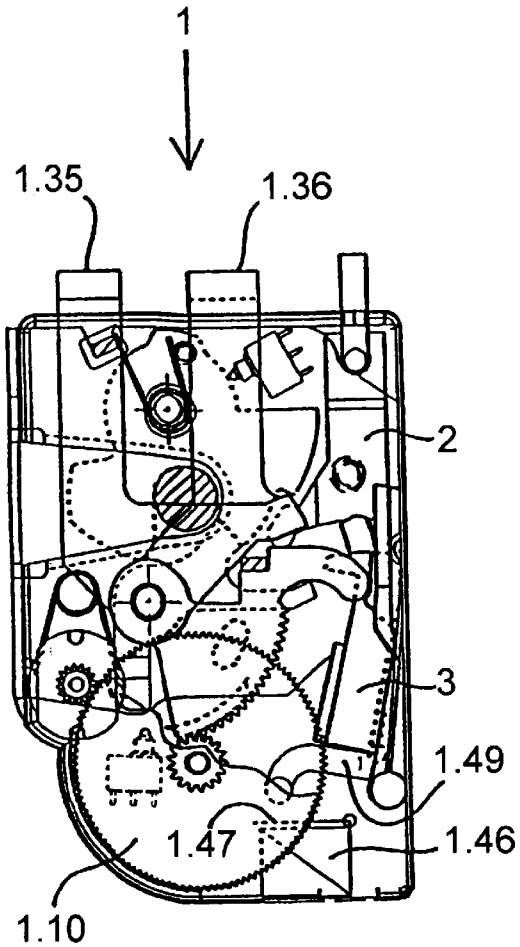
Figure 9F:
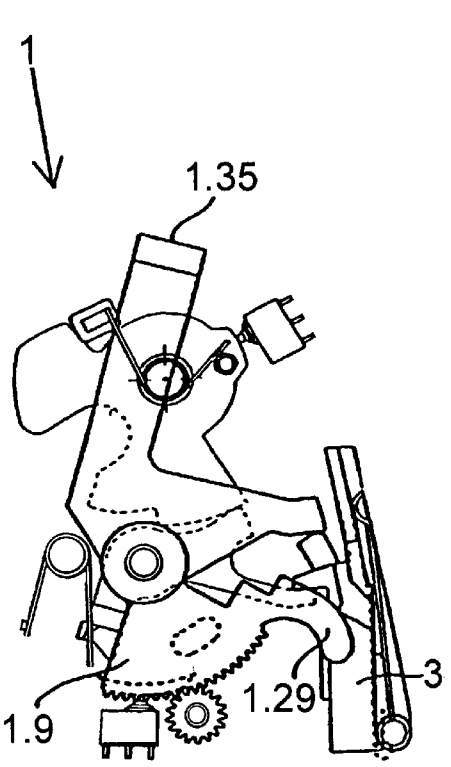
Figure 9E:
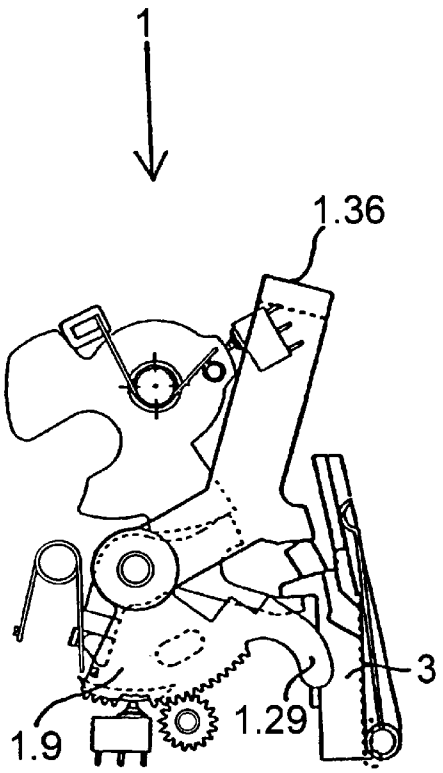
Figure 9D:
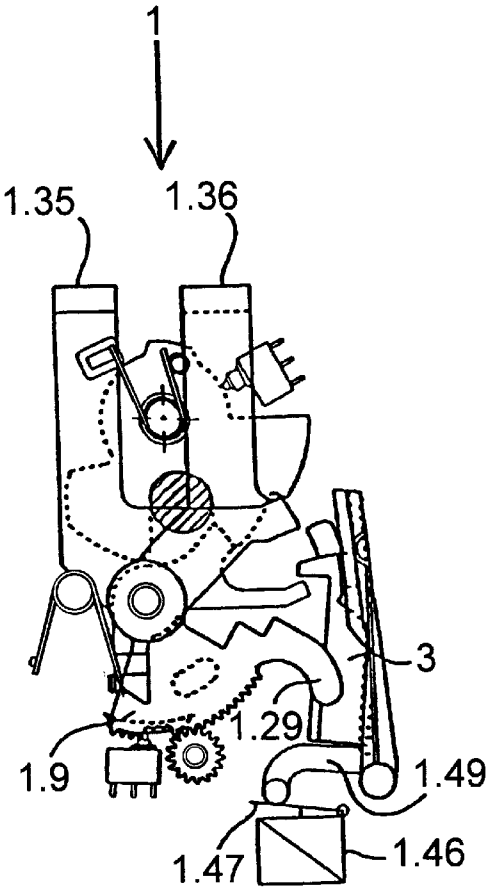
Figure 10C:
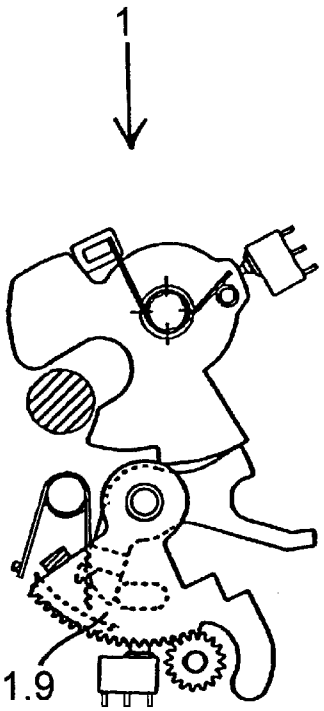
FIGS. 10A–10F are stylized elevational views presenting successive stages in the operation of a lock transmission device in accordance with an eighth embodiment of the invention.
Figure 10B:
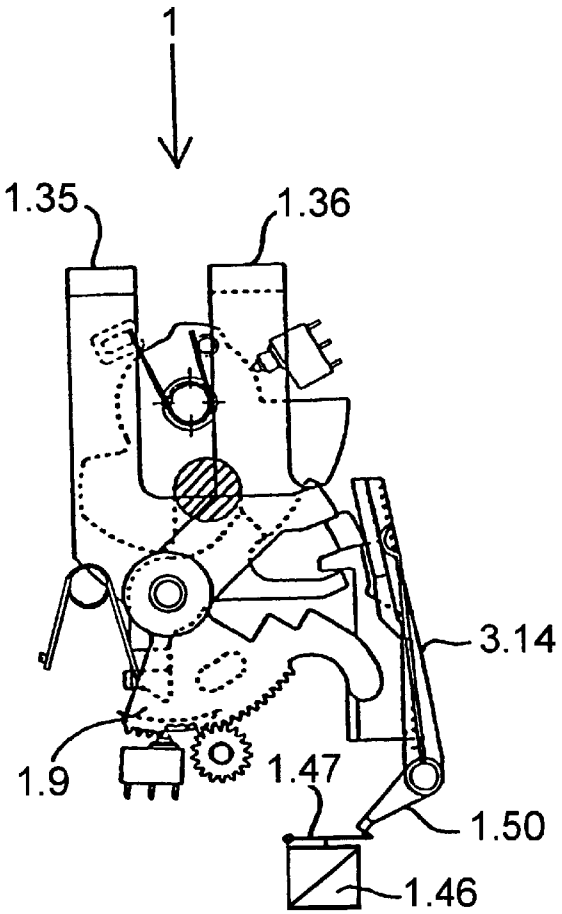
Figure 10A:
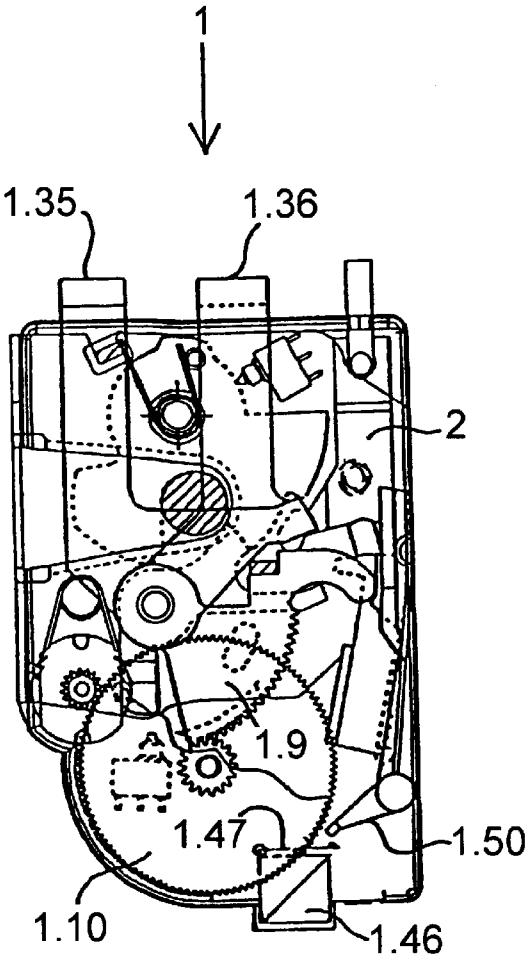
Figure 10F:
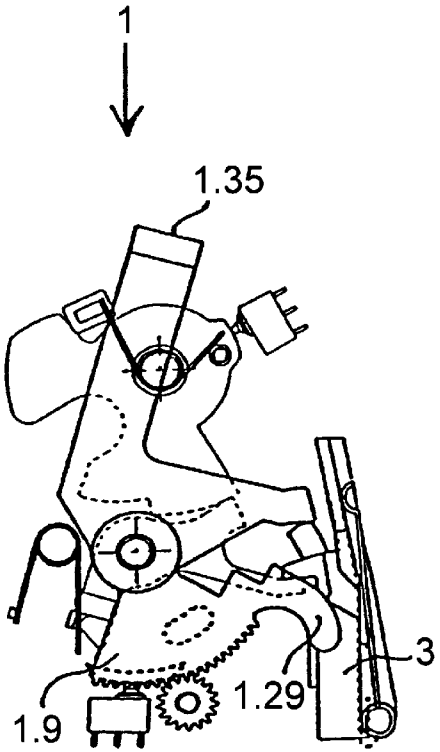
Figure 10E:
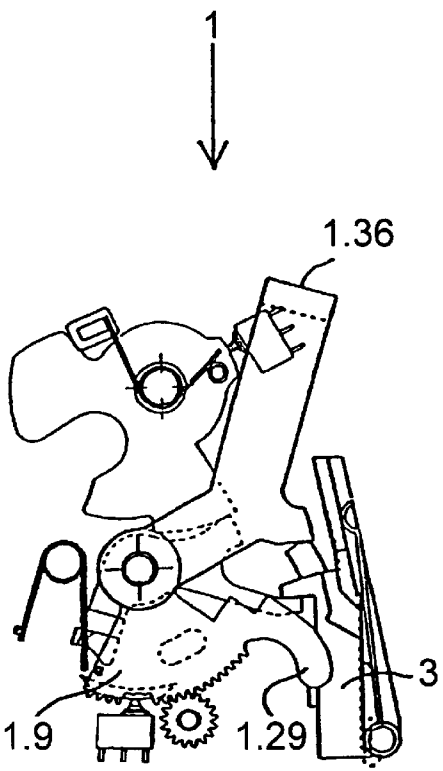
Figure 10D:
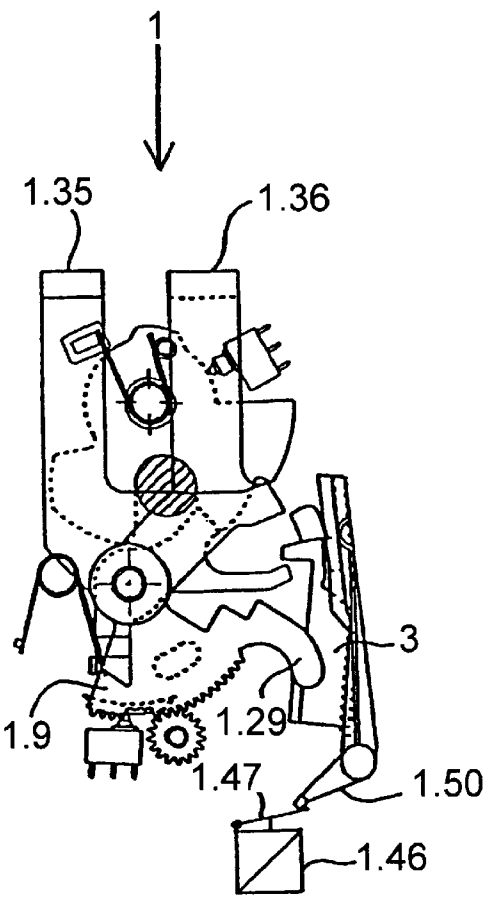

FIG. 9A shows an uncoupled position (an anti-theft position), there being a clapper relay 1.46 having a swing element 1.47 supplementing the lock 1 in this embodiment. Associated with the inner lever 3 or its resting part 3.14 there is a swing arm 1.49 which can be actuated by the swing element 1.47 upon actuation of the clapper relay 1.46. In the anti-theft position shown, the uncoupling of the inner lever 3 is effected by the arm 1.29 of the toothed segment 1.9. In this position, the clapper relay 1.46 is not actuated in order to save current. However, it is conceivable to actuate the clapper relay 1.46 also in the position shown in FIG. 9A in order to achieve an additional redundancy.

In FIG. 9B it is shown that the electric motor 1.7 has been actuated and the toothed segment 1.9 swung to such an extent that the inner lever 3 is operatively connected with the arm 1.22 of the pawl 1.3, but the rotary latch 1.1 has not yet been released by the pawl 1.3. In FIG. 9C it is shown that the toothed segment 1.9 has been swung further by the electric motor 1.7 so that the pawl 1.3 has released the rotary latch 1.1 and the door can be opened. In the position shown in FIG. 9D, which is a locked and/or child-secured position, the inner lever 3 is uncoupled by the actuated clapper relay 1.46 via the swing element 1.47 and the swing arm 1.49. In this way, an opening of the door is possible only via actuation of the electric motor 1.7, possibly with consideration of an inserted child-proof device. In the event that the current supply is no longer available, the inner lever 3 is swung inward on the basis of the fact that the clapper relay 1.46 is then no longer actuated so that, in accordance with FIGS. 9E and 9F, an emergency opening (mechanical opening) of the door is possible by means of actuating elements 1.35 and 1.36.

In FIGS. 10A to 10F the same positions are shown as in FIGS. 9A to 9F, with the difference that the clapper relay 1.46 is arranged outside a region of movement of the inner lever 3. The movement of the clapper relay 1.46 is transmitted via a swing arm 1.50 to the inner lever 3. In contradistinction to this, the embodiment shown in FIG. 9 has the advantage that, with the same size of clapper relay, a larger moment of swing can be transmitted to the inner lever 3. In the embodiment in accordance with FIG. 10, the swing arm 1.50 is firmly attached to the resting part 3.14, the inner lever 3 being movable substantially linearly relative to the resting part 3.14. In this case also, the kinematic reversal is possible, so that the clapper relay 1.46 when acted on by current attracts the inner lever 3 which is thus brought out of engagement with the arm 1.22 and, in currentless condition, is pressed away by the spring-loaded inner lever 3 of the resting part 3.14. In this connection, for instance, a torsion spring can be arranged around the pivot point of the resting part 3.14.

As alternative to or in meaningful supplementation of the actuation of the inner lever 3 by means of the actuating elements 1.35 and 1.36 shown in FIGS. 9 and 10, the actuation could also be effected via the Bowden cable, the Bowden cables, the lock cylinder, via rods or else via the inner safety button.

Figures 11A, 11B, 11C, 11F:
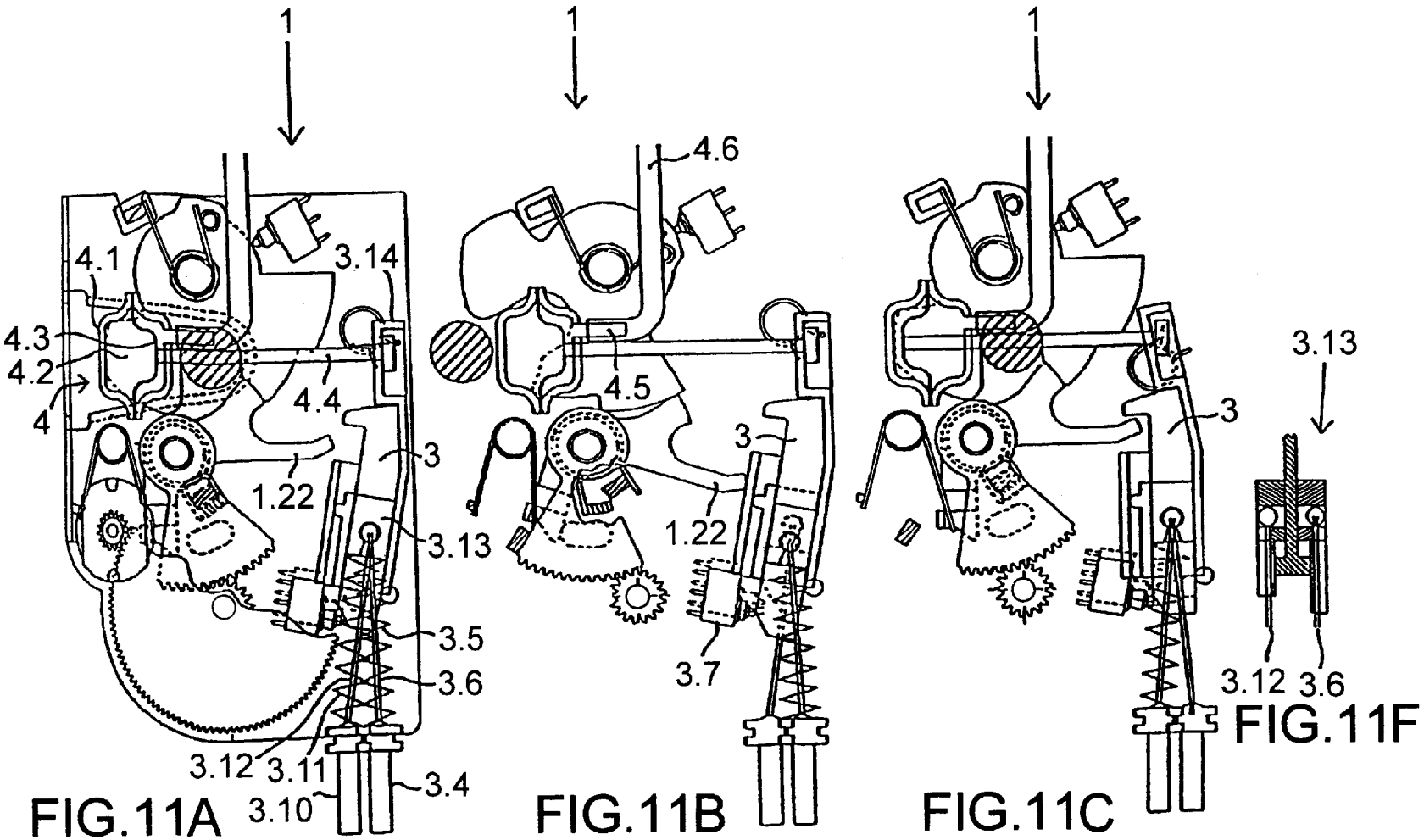
FIGS. 11A–11F are stylized elevational views presenting successive stages in the operation of a lock transmission device in accordance with a ninth embodiment of the invention.

The embodiment shown in FIGS. 11A–11F is also based on the structural embodiment shown in FIG. 1. In FIG. 11*a* there is shown an uncoupled position (an anti-theft position) in which the inner lever 3 is out of engagement with the lever arm 1.22. Thus, operation of the pawl 1.3 cannot take place either by movement of the inner lever 3 or by an electromotive movement. The lock 1 furthermore has a pneumatic setting device 4 which consists of a housing 4.1 with a membrane 4.3 in which a space 4.2 is sealed off by the membrane 4.3 from the surrounding atmosphere. On the membrane 4.3 there is arranged a ram 4.4 which, via a resting part 3.14 of the inner lever 3, holds the latter spaced from the lever arm 1.22. Furthermore, the pneumatic setting device 4 has a pressure opening 4.5 which is provided with a pressure connection 4.6 (FIG. 11B) which extends into a region in which the explosive pressure of the airbag or the belt tensioner is effectively detected.

FIG. 11B shows the open position of the lock 1, which is obtained in the normal case via the electromotive movement of the electric motor 1.7.

FIGS. 11C, 11F show, for the lock 1, in the situation of the malfunction in which, due to the explosive pressure of the airbag or the belt tensioner, the space 4.2 has been compressed so that the membrane 4.3 has swung around and the ram 4.4 has so moved that the projection of the inner lever 3 is operatively connected with the lever arm 1.22. For this malfunction, the pawl 1.22 can be brought out of its locked position into the open position by pulling the door inside handle (and thus shifting the slide-block 3.13 by the core 3.6), so that the door can be opened. The same applies in the event that a Bowden cable 3.10 is present, which also has a spring 3.11 and a core 3.12, the core 3.12 being connected with the door outside handle.

Figure 11E:
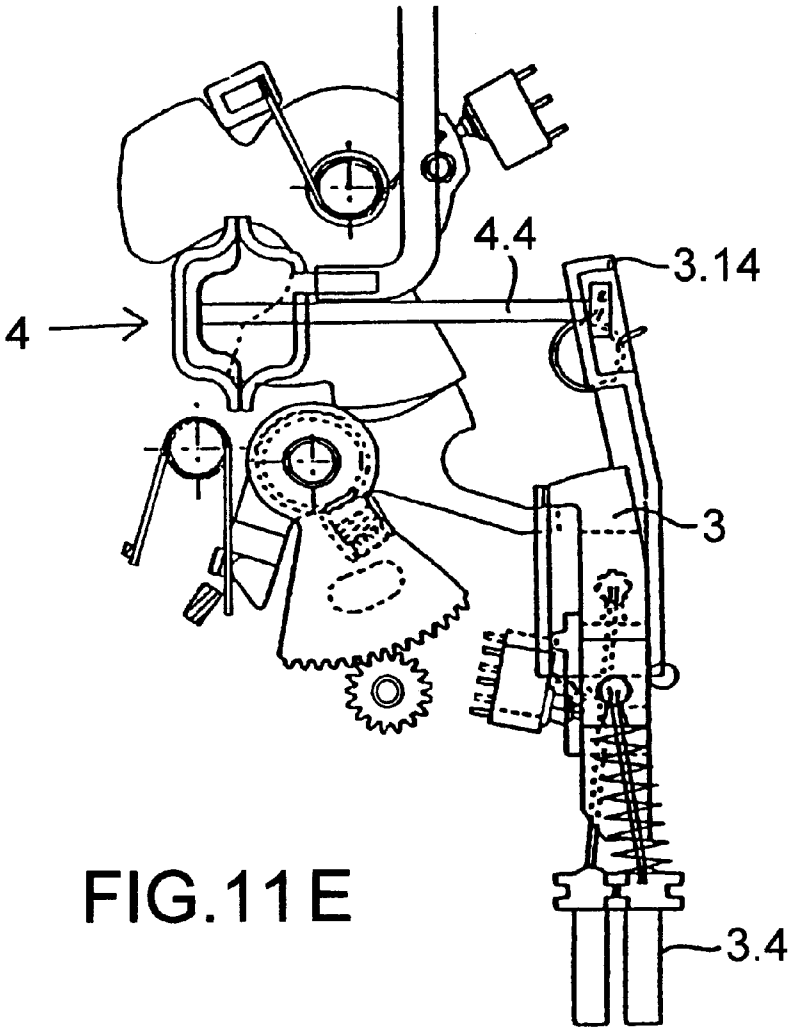
Figure 11D:
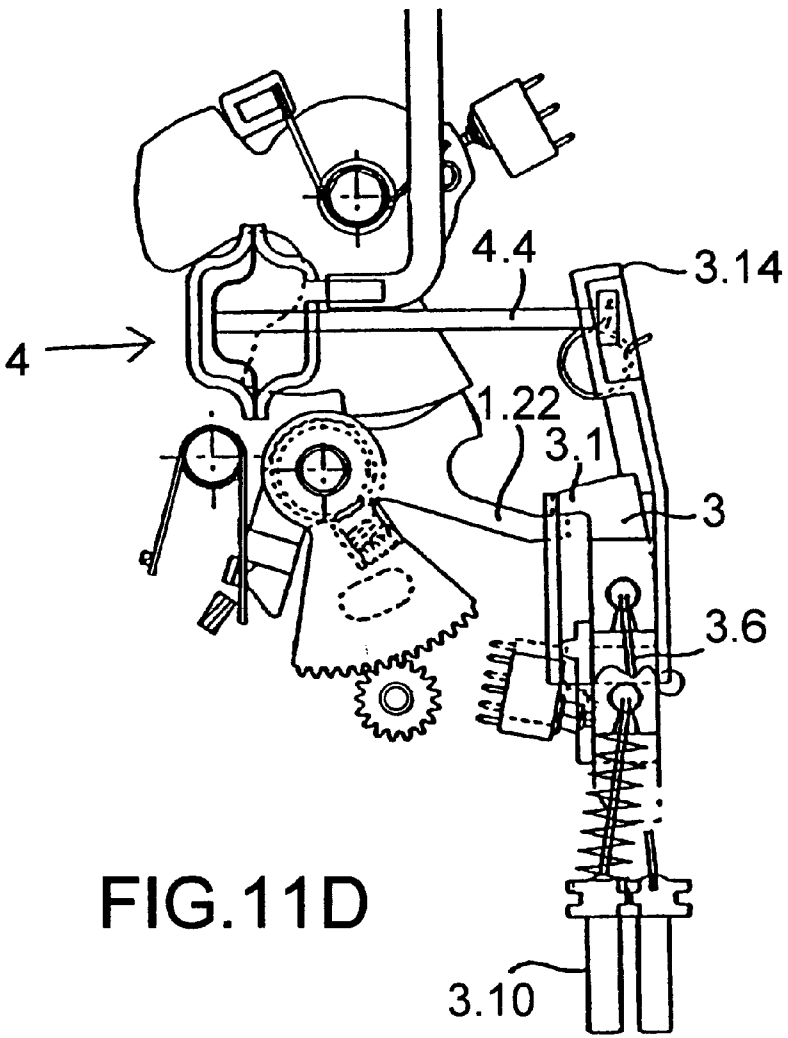

Thus it is shown in FIG. 11D that the door can be opened when the door outside handle is actuated and it is shown in FIG. 11E that the door can be opened when the door inside handle is actuated.

In the description of the manner of operation of the embodiment shown in FIGS. 11A–11F, it has been assumed that the movement of the pneumatic setting device 4 is brought about by a pressure (pressure wave of the released airbag, for instance). This has the advantage that this pneumatic setting device does not require electric energy. As an alternative to this, it is possible, for instance, in the embodiment of FIGS. 11A–11F, to make available an increased air pressure to the pneumatic setting device 4, for instance at the pressure connection 4.6, via an electrically actuatable valve. By means of the pressure then—with the reverse arrangement and manner of operation of the membrane 4.3—the inner lever is brought or held out of engagement with the lever arm 1.22 of the pawl 1.3. This is the case in the anti-theft and/or child-proof position (analogous use of the pneumatic setting device 4 of FIGS. 11A–11F in an embodiment for instance according to FIGS. 9A–9F). Upon failure of the current supply (for instance battery empty or its terminals disconnected or else after a crash), the valve closes, so that the spring-loaded inner lever 3 comes into engagement with the lever arm 1.22 of the pawl 1.3, so that a mechanical opening of the door by the manipulator via one of the Bowden cables 3.4 or 3.10 is possible.

Figure 12:
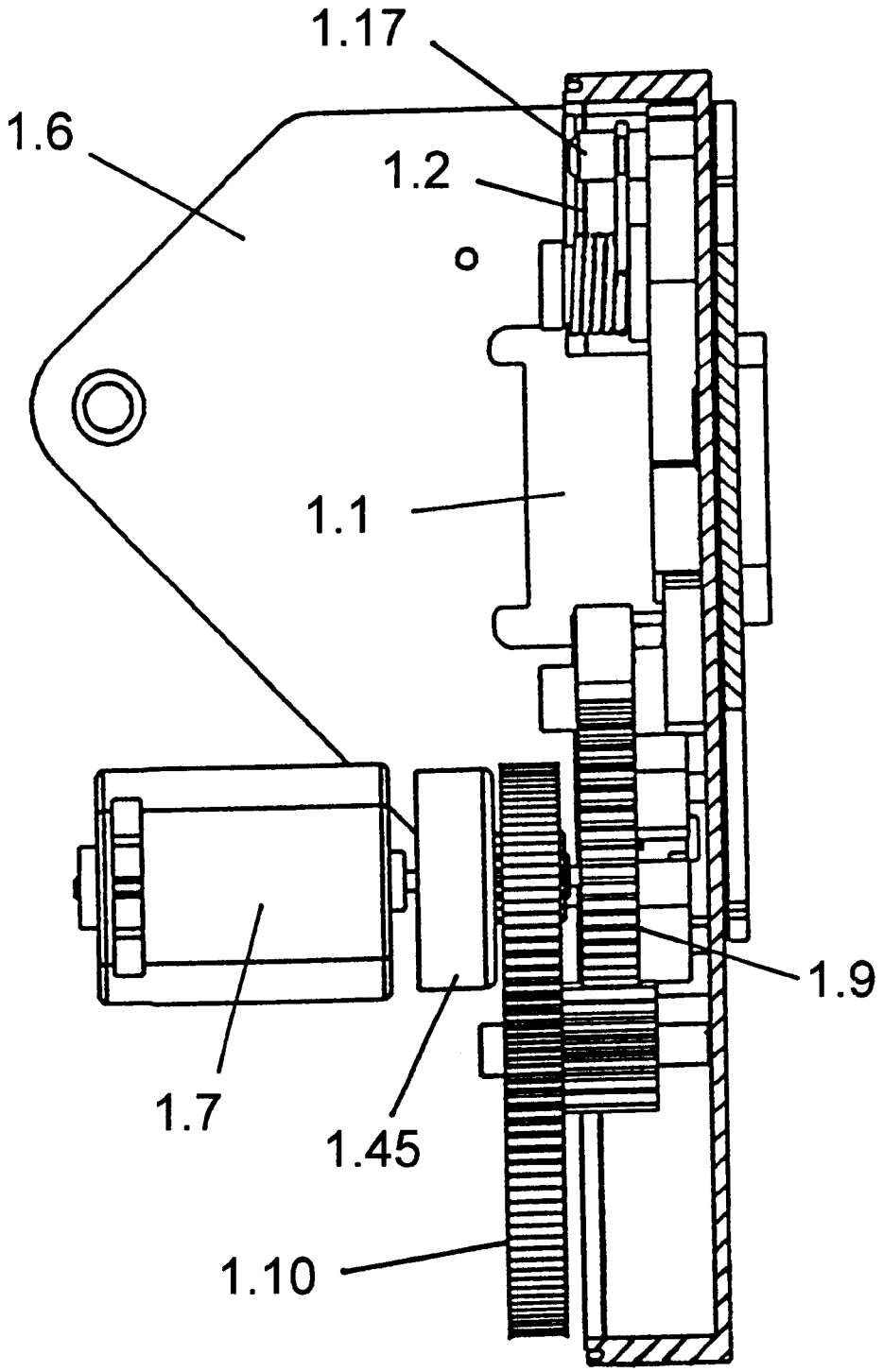
FIG. 12 is a cross section through the lock taken along the dashed line 12—12 in FIG. 1A.

FIG. 12 shows a cross section through the lock 1 along the dashed line shown in FIG. 1A.

It may also be pointed out that the lock described can be used in general in doors, trunk covers, glove compartments, gas-tank caps and the like in vehicles, particularly passenger vehicles. The control device can be coupled with a drive lock, so that the anti-theft position is set when the drive lock is active, or vice versa. In this condition an anti-theft warning system can also be activated simultaneously or with time delay.

We claim:

1. A lock suitable for use in a motor vehicle door, comprising:

a rotary latch, a locking wedge, a pawl, a setting device, and a transmission device;

wherein said rotary latch cooperates with said locking wedge to be locked in a locking position and held in said locking position by said pawl;

wherein said setting device includes motorized means, responsive to operation of a manipulator along a first path of travel, for driving said pawl to an opening position which frees said latch from said locking position, said manipulator comprising a handle;

said transmission device interconnects said manipulator with said pawl, and includes means responsive to operation of said manipulator along a second path of travel, longer than said first path of travel, for driving said pawl to said opening position; and said setting device is coupled to said pawl by a mechanical connection permitting said transmission device to displace said pawl to said opening position independently of a position of said setting device.

2. A lock according to claim 1, further comprising:

a control device having a actuation-detection device operative in response to a movement of the manipulator, and a signal line interconnecting the manipulator and the actuation-detection device to the setting device;

wherein said pawl has an arm, and said transmission device has at least a first swingable lever extending into a region of the pawl; and upon actuation of the manipulator and upon said actuation-detection device being placed in active position by the control device, said setting device acts on said pawl to bring said pawl into its opening position; and a projection of said lever of said transmission device is brought into operative connection with said arm of said pawl upon actuation of the manipulator.

3. A lock according to claim 2, further comprising a lock cylinder, and a second lever which is a linearly movable lever having a projection which is arranged in a region of said pawl;

wherein said second lever is brought into operative connection with said arm of said pawl upon actuation of said lock cylinder.

4. A lock according to claim 3, further comprising a second setting device coupled directly, or with the interposition of transmission elements, to said transmission device.

5. A lock according to claim 4, wherein said first lever of said transmission device is operatively coupled to said second setting device.

6. A lock according to claim 5, wherein said first lever is an inner lever of said lock.

7. A lock according to claim 4, wherein said second setting device is an electromotive, an electromagnetic or a clapper relay, or a pneumatic setting device.

8. A lock according to claim 3, wherein at least one of said first and said second levers is spring-loaded in a direction of swing.

9. A lock according to claim 3, wherein at least one of said first and said second levers is connected by a Bowden cable to said manipulator and is actuatable independently of the other by said manipulator.

10. A lock according to claim 9, wherein said manipulator is an inside or outside door handle.

11. A lock according to claim 3, wherein at least one of said first and said second levers is connected by a Bowden cable to said lock cylinder and is actuatable independently of the other by said manipulator.

12. A lock according to claim 3, wherein said lock further comprises two Bowden cables connecting with a slide-block pusher, said first lever of said transmission device terminates in said slide-block pusher; and said pusher is slidably displaced by a core of either one of said Bowden cables.

13. A lock according to claim 12, wherein said pusher comprises two parts, said parts being connected with respective ones of the Bowden cables.

14. A lock according to claim 3, further comprising an inner safety button; and wherein said pawl has a lever arm which is connected by connecting elements to said inner safety button.

15. A lock according to claim 14, further comprising connecting elements for a direct or indirect movement of said pawl into its open position, said connecting elements being arranged between said manipulator and said pawl.

16. A lock according to claim 15, wherein movement of said pawl is accomplished via said second lever.

17. A lock according to claim 3, wherein said setting device has moving means which, in a third position of said setting device, moves a projection of at least one of said first and said second levers out of the region of said pawl for inhibiting a bringing of said pawl into its open position by an actuation of the manipulator.

18. A lock according to claim 17, wherein the third position of said setting device, at least when energy is present in said setting device, produces an anti-theft position of said lock in which said pawl cannot be brought into the open position either electromechanically or via said transmission device.

19. A lock according to claim 3, wherein at least one of said first and said second levers is spring-loaded in a direction of actuation.

20. A lock according to claim 3, wherein at least one of said first and said second levers is spring-loaded in a direction of swing and of actuation.

21. A lock suitable for use in a motor vehicle door, comprising:

a rotary latch, a locking wedge, a pawl, a setting device, and a transmission device;

wherein said rotary latch cooperates with said locking wedge to be locked in a locking position and held in said locking position by said pawl;

wherein said setting device includes motorized means, responsive to operation of a manipulator along a first path of travel, for driving said pawl to an opening position which frees said latch from said locking position, said manipulator comprising a handle;

said transmission device interconnects said manipulator with said pawl, and includes means responsive to operation of said manipulator along a second path of travel, longer than said first path of travel, for driving said pawl to said opening position; and said setting device is coupled to said pawl by a mechanical connection permitting said transmission device to displace said pawl to said opening position independently of a position of said setting device;

an inner safety button; and wherein said pawl has a lever arm which is connected by connecting elements to said inner safety button.

22. A lock according to claim 21, further comprising connecting elements for a direct or indirect movement of said pawl into its open position, said connecting elements being arranged between said manipulator and said pawl.

* * * * *